US011904213B2

(12) United States Patent
Morris et al.

(10) Patent No.: US 11,904,213 B2
(45) Date of Patent: Feb. 20, 2024

(54) BASKETBALL AND RELATED MANUFACTURING METHODS

(71) Applicant: Kristafer Wilkes, Los Angeles, CA (US)

(72) Inventors: Jacob Morris, Indianapolis, IN (US); Kristafer Wilkes, Los Angeles, CA (US)

(73) Assignee: Kristafer Wilkes, Los Angeles, CA (US)

( * ) Notice: Subject to any disclaimer, the term of this patent is extended or adjusted under 35 U.S.C. 154(b) by 0 days.

(21) Appl. No.: 17/538,686

(22) Filed: Nov. 30, 2021

(65) Prior Publication Data

US 2022/0184462 A1 Jun. 16, 2022

Related U.S. Application Data

(60) Provisional application No. 63/199,173, filed on Dec. 11, 2020.

(51) Int. Cl.

| | |
|---|---|
| ***A63B 41/08*** | (2006.01) |
| ***A63B 41/02*** | (2006.01) |
| ***A63B 43/00*** | (2006.01) |

(52) U.S. Cl.

CPC ..... *A63B 41/08* (2013.01); *A63B 41/02* (2013.01); *A63B 43/008* (2013.01); *A63B 2243/0037* (2013.01)

(58) Field of Classification Search

CPC . A63B 41/02; A63B 2243/0037; A63B 41/08; A63B 43/008

See application file for complete search history.

(56) References Cited

U.S. PATENT DOCUMENTS

| | | | | |
|---|---|---|---|---|
| 3,256,019 | A * | 6/1966 | Barton | A63B 41/00 156/170 |
| 3,475,027 | A * | 10/1969 | Henderson | A63B 39/00 473/597 |
| 3,508,750 | A * | 4/1970 | Henderson | A63B 39/00 473/605 |
| 3,512,777 | A * | 5/1970 | Henderson | A63B 41/08 156/170 |
| 6,099,423 | A * | 8/2000 | Ou | A63B 41/08 473/604 |

(Continued)

OTHER PUBLICATIONS

ShotRx basketball; disclosed by Jeff Kontor approximately Jun. 2020. (1 page).

(Continued)

*Primary Examiner* — Steven B Wong

(74) *Attorney, Agent, or Firm* — Barnes & Thornburg LLP

(57) ABSTRACT

A basketball that comprises a carcass and a cover assembly. The carcass includes a plurality of recess disposed between a plurality of grooves. The cover assembly includes a plurality of cover panels positioned within the recesses. Each of the plurality of grooves comprises a central channel. The central channel is defined by a bottom wall, a first side wall, and a second side wall. The first and second side walls are substantially planar. The central channel defines a channel depth of between about 3 mm and about 4 mm, and each of the plurality of grooves defines a ridge distance of between about 10 mm and about 12 mm.

20 Claims, 13 Drawing Sheets

(56) References Cited

U.S. PATENT DOCUMENTS

| | | | | |
|---|---|---|---|---|
| 6,123,633 | A * | 9/2000 | Guenther | A63B 41/08 473/604 |
| 6,406,389 | B1 * | 6/2002 | Feeney | A63B 41/08 473/604 |
| 6,422,961 | B1 * | 7/2002 | Feeney | A63B 41/08 473/604 |
| 6,506,135 | B2 * | 1/2003 | Ou | A63B 41/08 156/172 |
| D685,868 | S * | 7/2013 | Krysiak | D21/707 |
| D686,678 | S * | 7/2013 | Krysiak | D21/707 |
| 8,617,011 | B2 * | 12/2013 | Berggren | B29C 65/08 473/604 |
| 9,114,286 | B2 * | 8/2015 | Krysiak | A63B 41/08 |
| 9,901,786 | B2 * | 2/2018 | Krysiak | A63B 41/02 |
| 11,097,164 | B2 | 8/2021 | Krysiak et al. | |
| 2002/0098928 | A1 * | 7/2002 | Ou | A63B 41/08 473/604 |
| 2004/0259670 | A1 * | 12/2004 | Chang | A63B 41/00 473/598 |
| 2005/0153803 | A1 * | 7/2005 | Swiszcz | A63B 41/08 473/593 |
| 2007/0238562 | A1 * | 10/2007 | Nagao | A63B 41/08 473/605 |
| 2009/0325742 | A1 * | 12/2009 | Krysiak | A63B 41/08 473/605 |
| 2013/0260927 | A1 * | 10/2013 | Thurman | A63B 41/00 473/595 |
| 2019/0160346 | A1 * | 5/2019 | Feng | B32B 3/10 |

OTHER PUBLICATIONS

"Stealth inverted black and orange basketball Vector Image" https://www.vectorstock.com/royalty-free-vector/stealth-inverted-black-and-orange-basketball-vector-33228742, published Aug. 28, 2020, accessed Feb. 16, 2022. (4 pages).

"Franklin Sports 5000 Official Size 29.5-Inch Basketball" https://www.kohls.com/product/prd-4351615/franklin-sports-5000-official-size-295-inch-basketball.jsp?color=Orange&prdPV=7, published Sep. 11, 2019, accessed Feb. 16, 2022 (2 pages).

"Home—Origin Sport" https://origynsport.com/#buynow, published May 3, 2021, accessed Feb. 16, 2022 (3 pages).

* cited by examiner

BASKETBALL AND RELATED MANUFACTURING METHODS

CROSS REFERENCE TO RELATED APPLICATIONS

This application is based on, claims priority to, and incorporates herein by reference in its entirety U.S. Provisional Application Ser. No. 63/199,173, filed on Dec. 11, 2020, and entitled "BASKETBALL, METHOD OF MANUFACTURE, METHOD OF USE AND METHOD OF TRAINING AND INSTRUCTION."

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates to sporting equipment, and more particularly to a basketball and related manufacturing methods.

2. Description of the Background

Basketballs typically include an arrangement of interconnected seams or grooves formed into an outer surface of the basketball. The grooves typically are arranged to define multiple cover regions in the outer surface of the basketball. Further, the grooves can facilitate a player's ability to grasp, handle, shoot, pass, dribble, and otherwise control the basketball during play. Most players, if given the time during play, will rotate the basketball in their hands prior to shooting in order for them to algin one or more of their fingertips with one or more of the grooves on the basketball. Such alignment can facilitate the player's ability to shoot the basketball and to impart a spin on the ball upon shooting.

Finding the grooves and seeing the rotation of the ball are both needed to help improve a player's ability to control the basketball and increase their shooting percentage. Without proper fingertip control and backspin on the basketball throughout a shot form, the basketball has a much lower chance of going in through the hoop. This is hard to teach without a physical product that explains and teaches fingertip control and backspin. Furthermore, ball handling is a key trait to increase the player's ability to thrive within the sport. Although most basketballs include grooves positioned therein, a standard basketball is not optimal for training and teaching the fundamentals of basketball, and effectively and consistently shooting a basketball through a basketball hoop.

Therefore, basketballs, and their grooves and methods of manufacturing, may be optimized to provide a user with better training by allowing the user to see the rotation of the ball and get a better feel for the grooves. As such, a need exists for a basketball that can be used during training to provide a user assistance in properly grasping the basketball, shooting, and ball control.

Thus, a basketball and a method for manufacturing a basketball with better training features are desired. These and other deficiencies with the prior art are outlined in the following disclosure.

SUMMARY

A basketball, as described herein, may have various configurations. The basketball may comprise a carcass and a cover assembly. The carcass may include a plurality of recesses disposed between a plurality of grooves. The cover assembly may include a plurality of cover panels positioned within the recesses. Each of the plurality of grooves may comprise a central channel. The central channel may be defined by a bottom wall, a first side wall, and a second side wall.

In one aspect, a basketball comprises a carcass and a cover assembly. The carcass includes a plurality of recesses disposed between a plurality of grooves. The cover assembly includes a plurality of cover panels positioned within the recesses. Each of the plurality of grooves comprises a central channel. The central channel is defined by a bottom wall, a first side wall, and a second side wall. The first and second side walls are substantially planar. The central channel defines a channel depth of between about 3 mm and about 4 mm, and each of the plurality of grooves defines a ridge distance of between about 10 mm and about 12 mm.

In some embodiments, the channel depth is about 3.5 mm. In some embodiments, the ridge distance is about 11 mm. In some embodiments, the bottom wall defines a bottom wall length, and the bottom wall length is between about 2 mm and about 4 mm. Each of the grooves define an outer wall distance. The outer wall distance is between about 13 mm and about 15 mm. In some embodiments, the bottom wall, the first side wall, and the second side wall create a trapezoidal shape in the central channel. In some embodiments, the basketball comprises a highly contrasted color scheme. The plurality of cover panels is black, and the plurality of grooves are orange.

In another aspect, a basketball defines a center point and the basketball comprises a carcass and a cover assembly. The carcass includes a bladder and a plurality of grooves. The bladder comprises an outer surface. The cover assembly includes a plurality of cover panels that are spaced apart by the plurality of grooves. Each of the plurality of grooves comprises a bottom wall positioned between a first rib and a second rib. The first rib comprises a first ridge and the second rib comprises a second ridge. The basketball defines a first radius (R1) from the center point of the basketball to the outer surface of the bladder, a second radius (R2) from the center point of the basketball to the first or second ridge, and a third radius (R3) from the center point of the basketball to the bottom wall of the groove. A difference between the first radius and the third radius (R1-R3) is bigger than a difference between the second radius and the first radius (R2-R1).

In some embodiments, the first ridge and the second ridge are parallel with the bottom wall. In some embodiments, each of the plurality of grooves comprises a first side wall and a second side wall. The first side wall and the second side wall extend from the bottom wall at a side wall angle. The side wall angle is greater than 90°. Each of the plurality of grooves comprises a first outer wall that extends radially away from the center point of the basketball and is connected to a first upper wall. The first side wall and the first upper wall are connected by the first ridge. The first side wall, the first outer wall, the first upper wall, and the first ridge define the first rib.

In yet another aspect, a basketball comprises a carcass, a first cover panel, and a second cover panel. The carcass includes a bladder and at least one groove. The at least one groove is positioned between the first cover panel and the second cover panel. Each of the first cover panel and the second cover panel comprises a middle region and a peripheral region. The at least one groove comprises a bottom wall positioned between a first rib and a second rib. The at least one groove comprises a central channel disposed between the first rib, the second rib, and the bottom wall. The at least one groove comprises a first side channel between the first rib and the middle region of the first cover panel. The at least one groove comprises a second side channel between the second rib and the middle region of the second cover panel.

In some embodiments, a thickness of the first cover panel and the second cover panel tapers within the peripheral regions. In some embodiments, the at least one groove is positioned between peripheral edges of the first cover panel and the second cover panel. The at least one groove comprises a first and second side wall and a first and second outer wall. The first and second side wall extend from the bottom wall, and the first and second outer wall extend radially away from the bladder and are connected to a first upper wall and a second upper wall, respectively. The first side wall and the first upper wall are connected by a first ridge. The second side wall and the second upper wall are connected by a second ridge. The first side wall, the first outer wall, the first upper wall, and the first ridge define the first rib of the at least one groove. The second side wall, the second outer wall, the second upper wall, and the second ridge define the second rib of the at least one groove. The first upper wall and the second upper wall abut the peripheral edges of the first cover panel and the second cover panel, respectively.

Other aspects of the basketball described herein, including features and advantages thereof, will become apparent to one of ordinary skill in the art upon examination of the figures and detailed description herein. Therefore, all such aspects of the basketball are intended to be included in the detailed description and this summary.

DETAILED DESCRIPTION OF THE DRAWINGS

Figure 1:
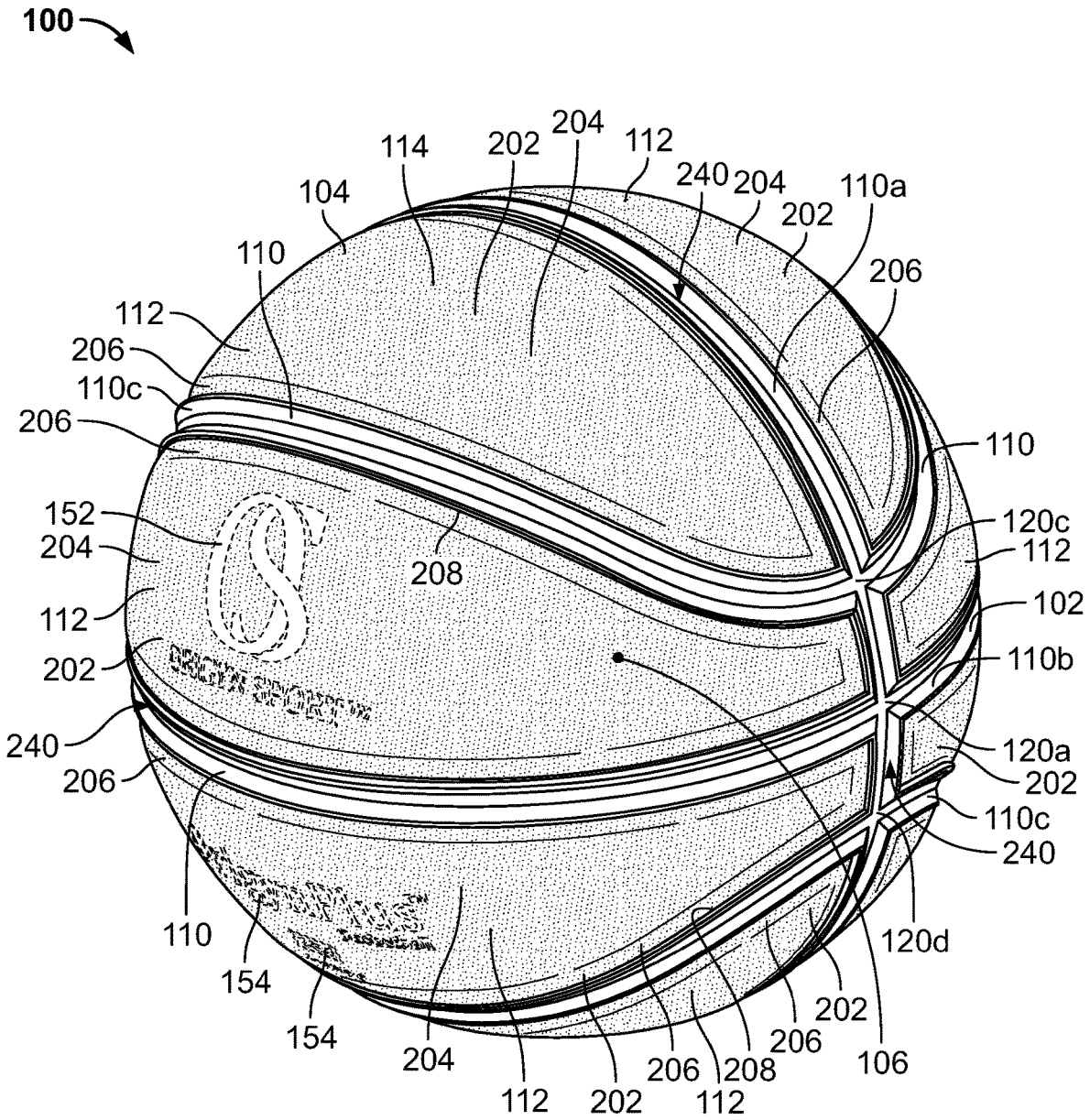
FIG. 1 is a top, right, and front perspective view of a basketball.
Figure 2:
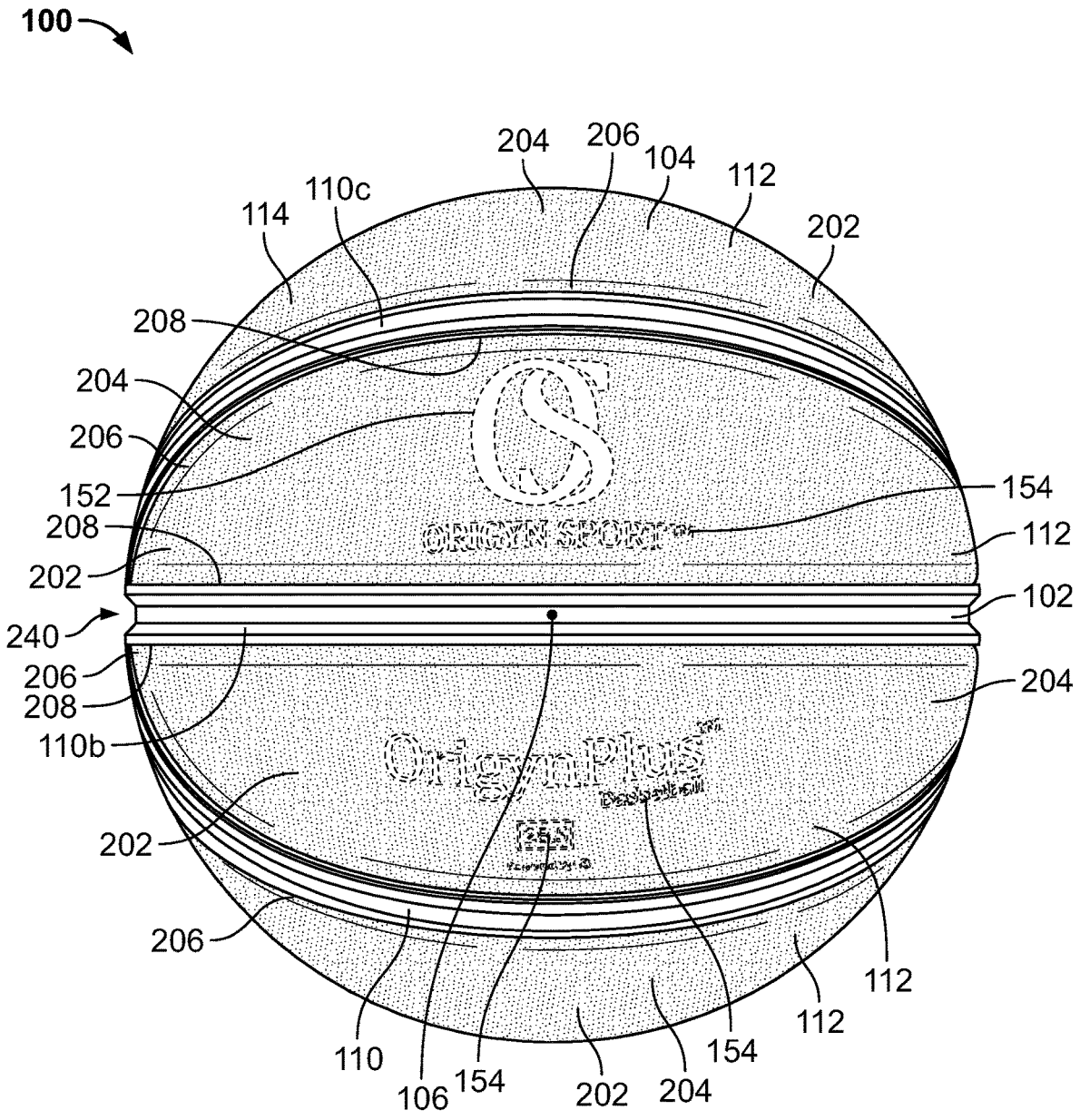
FIG. 2 is a front view of the basketball of FIG. 1.
Figure 3:
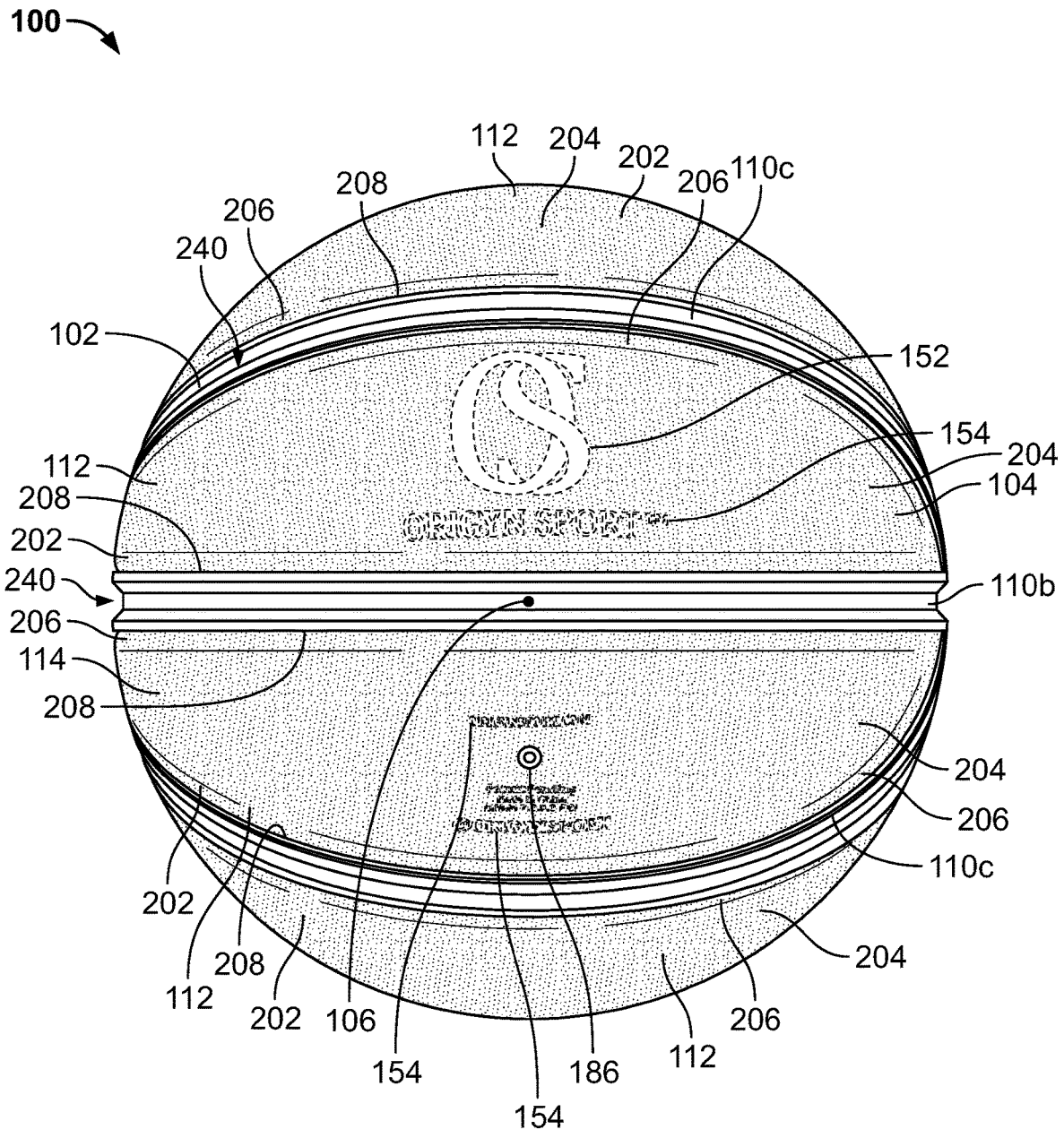
FIG. 3 is a rear view of the basketball of FIG. 1.

The following discussion and accompanying figures disclose various embodiments or configurations of a basketball having enlarged grooves. Although embodiments are disclosed with reference to a basketball, concepts associated with embodiments of the basketball may be applied to a wide range of sporting equipment, including baseballs, footballs, soccer balls, tennis balls, volleyballs, rugby balls, and other sporting balls, for example.

In an exemplary embodiment of the present invention, a basketball is constructed and arranged for use in training and instruction and has dimensions which differ from standard or regulation basketballs. A basketball in accordance with the present invention may comprise deeper and wider grooves as compared to a regulation ball, constructed and arranged to provide a user assistance in properly grasping a basketball, for effective use and ball control. A basketball in accordance with the present invention may further comprise a different color scheme than the color scheme of a standard or regulation basketball, to support visualization of the rotation of a basketball during use.

The term "about," as used herein, refers to variations in the numerical quantity that may occur, for example, through typical measuring and manufacturing procedures used for basketballs or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

FIGS. 1-7 depict an exemplary embodiment of a basketball 100 including a carcass 102 and a cover assembly 104. As illustrated in FIGS. 1-7, the basketball 100 is a generally spherical inflatable object that defines a center point 106 in the middle of the sphere. The carcass 102 is a combination of ball components that are molded in a carcass-forming mold to produce an inflated ball structure. The carcass 102 includes a bladder 108 (see FIGS. 8 and 9), a plurality of grooves or channels 110, and a layer of threading (not shown). In some embodiments, the carcass 102 may include one or more layers of elastomeric material that is disposed over the layer of threading. As will be discussed in further details herein, the cover assembly 104 includes a plurality of cover panels 112 that are spaced apart by the plurality of grooves 110 extending outwardly and within the carcass 102.

Figure 4:
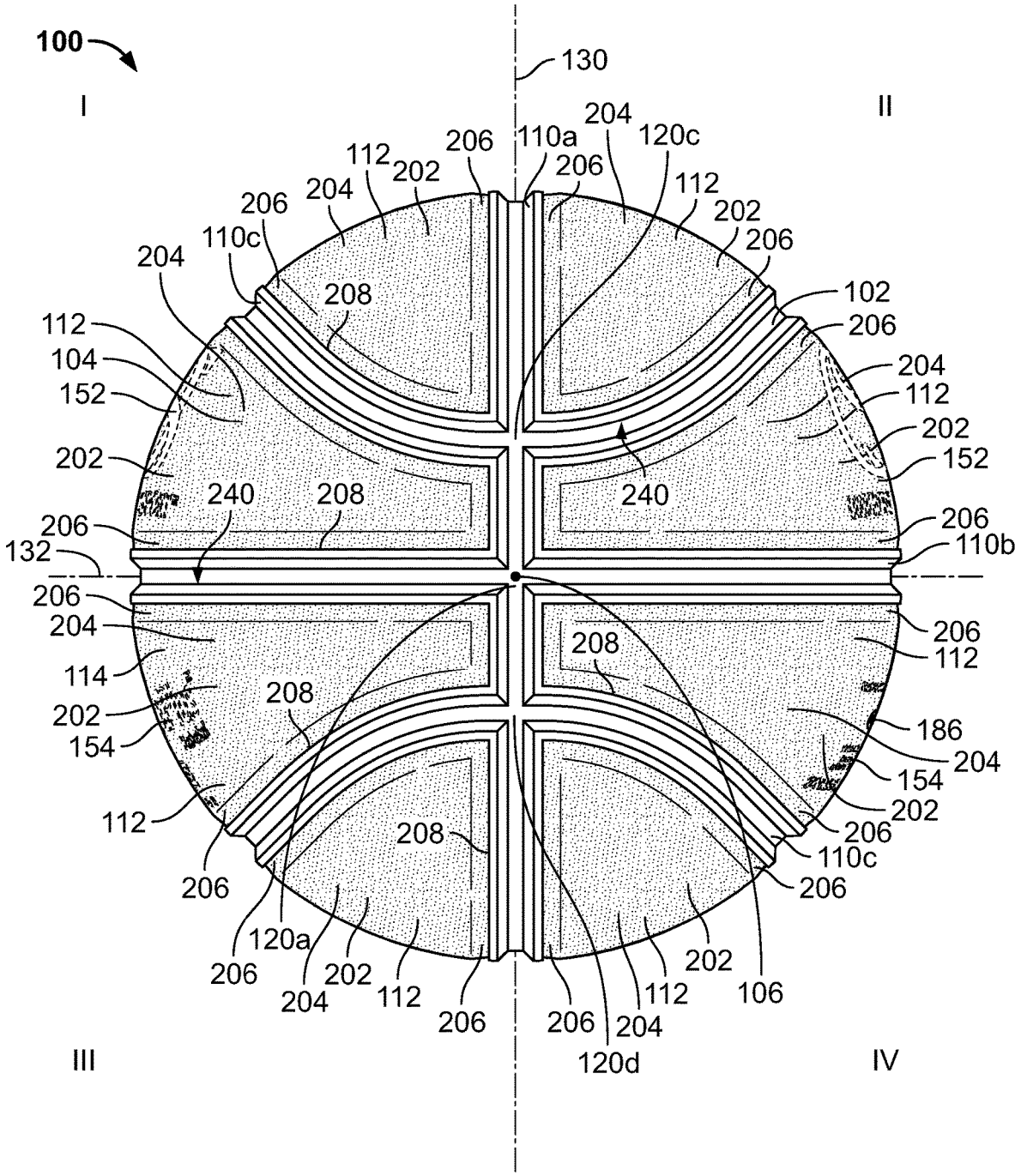
FIG. 4 is a right side view of the basketball of FIG. 1.
Figure 5:
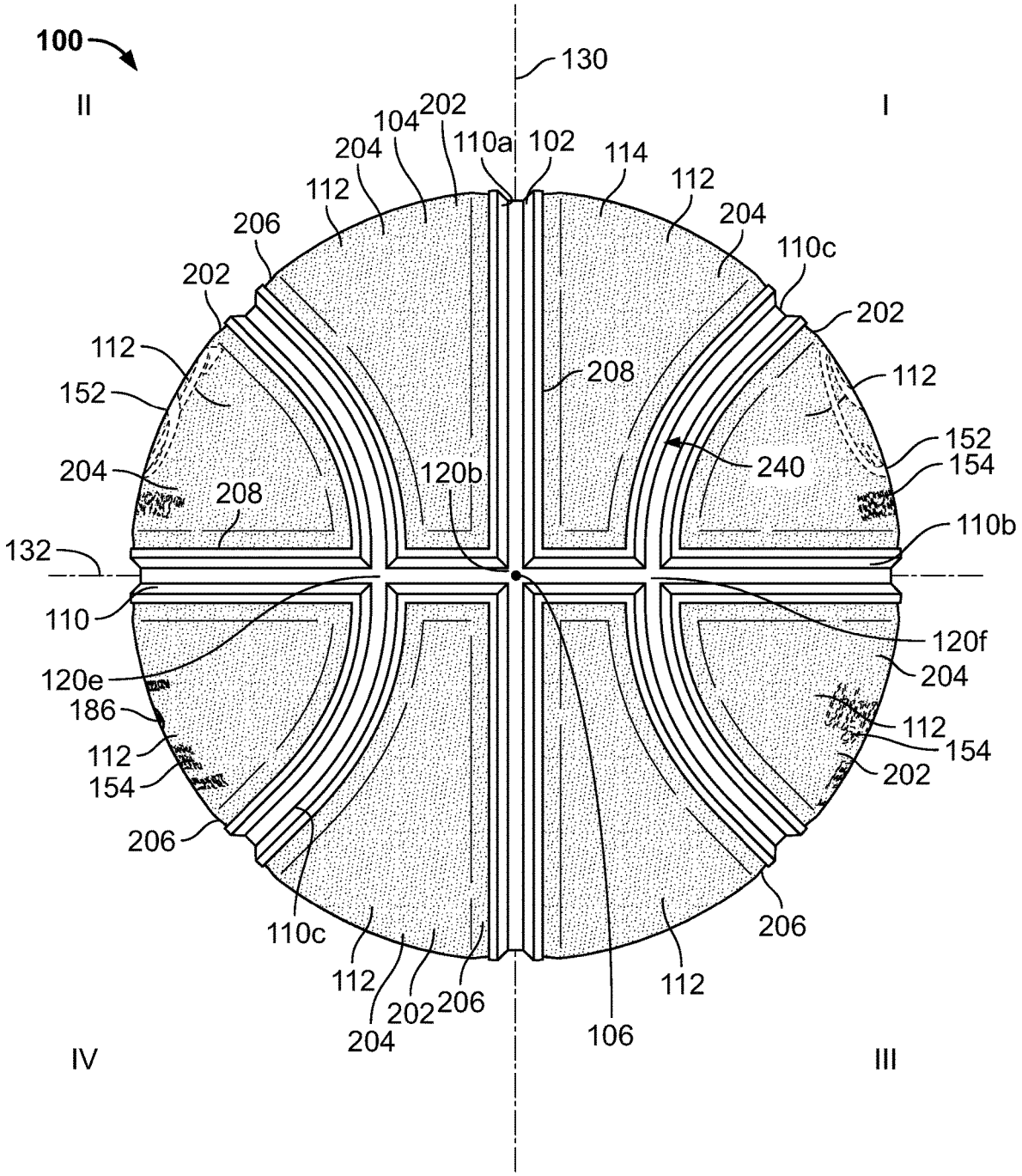
FIG. 5 is a left side view of the basketball of FIG. 1.
Figure 6:
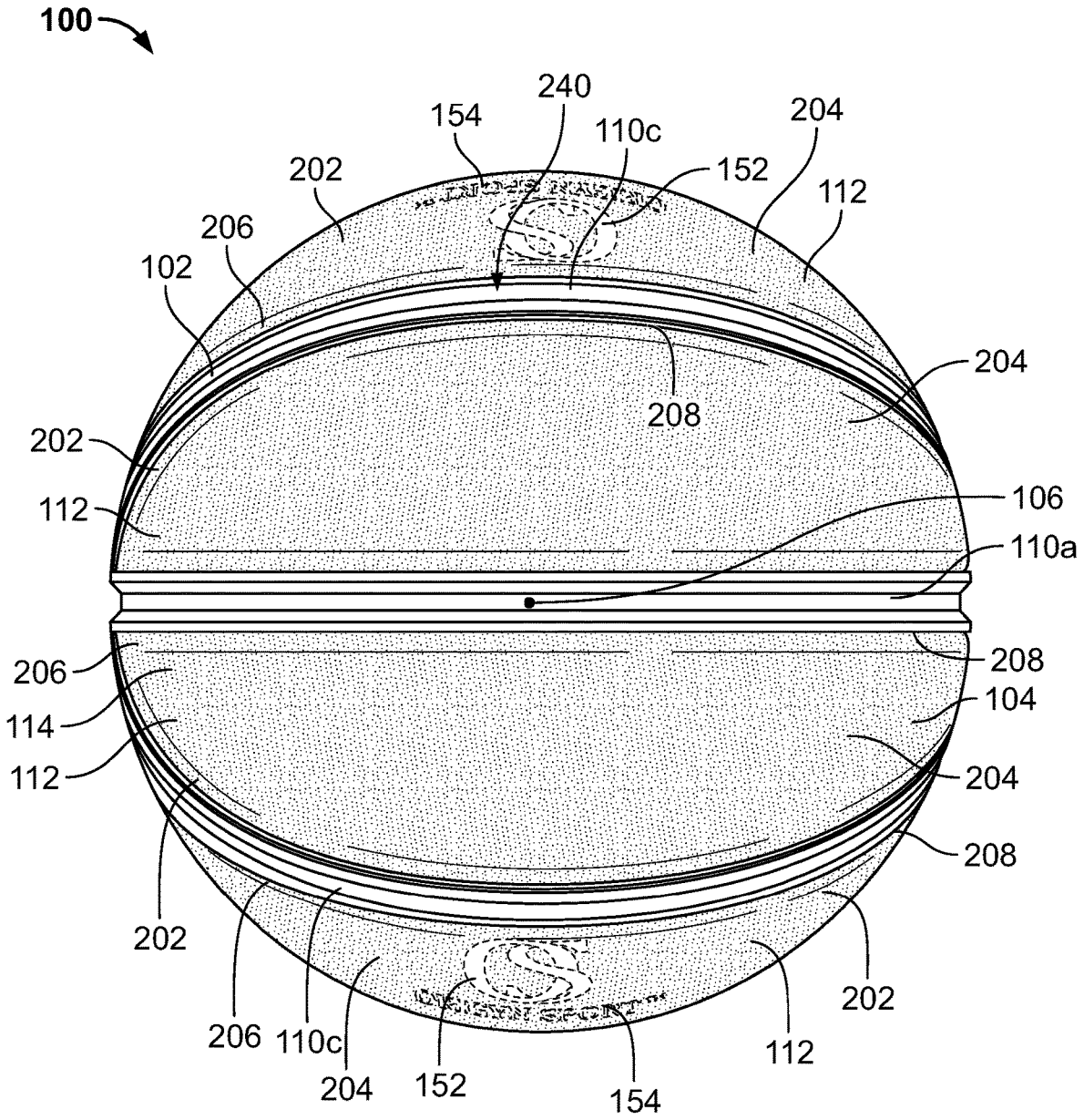
FIG. 6 is a top view of the basketball of FIG. 1.
Figure 7:
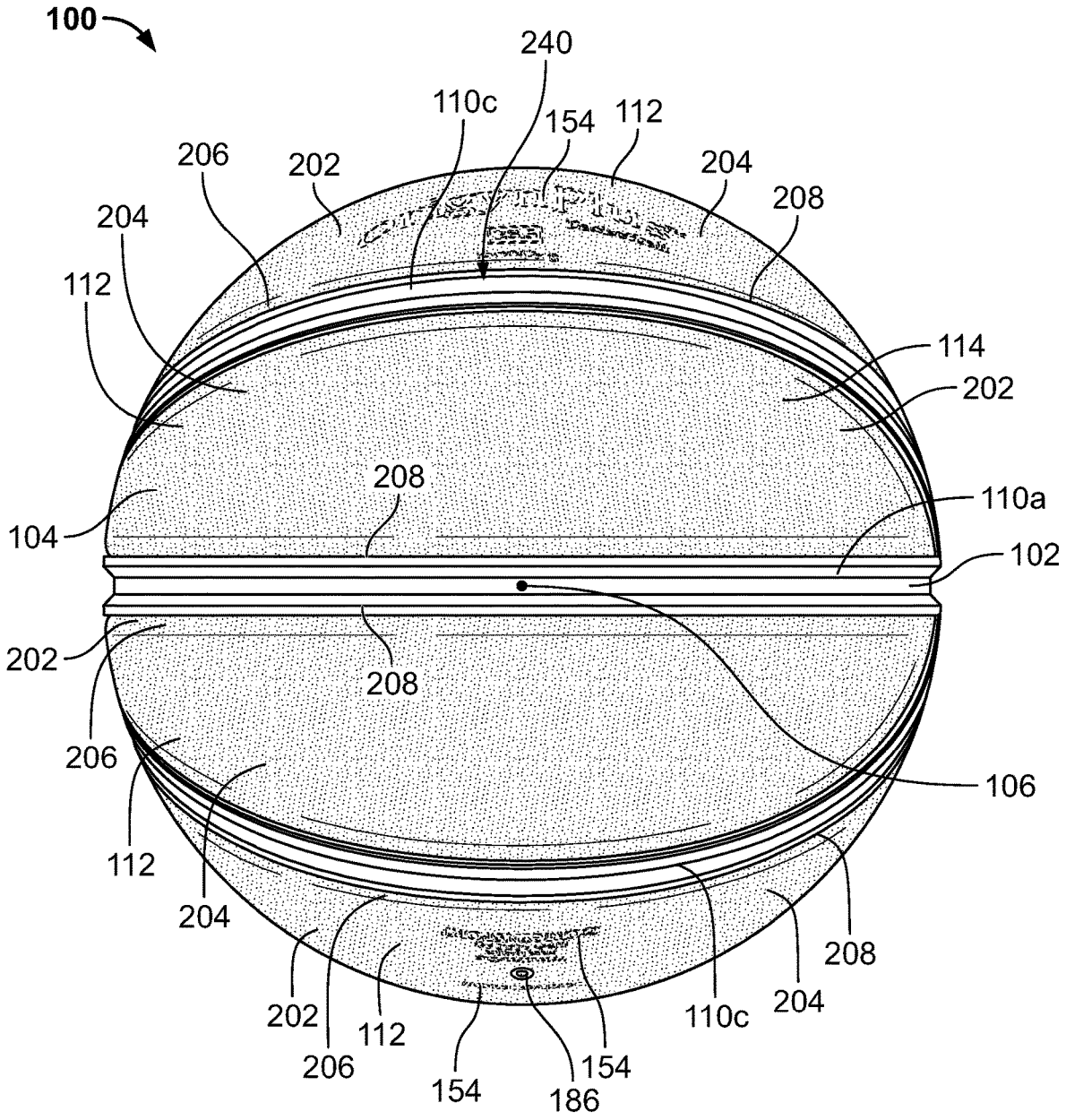
FIG. 7 is a bottom view of the basketball of FIG. 1.

Referring still to FIGS. 1-7, the plurality of grooves 110 extend around an outer portion 114 of the basketball 100. As illustrated in FIG. 1, the basketball 100 comprises three continuous grooves 110 that extend along the outer portion 114 of the basketball 100 along different routes or portions of the basketball 100. The plurality of grooves 110 intersect each other at a plurality of intersections 120. In preferred embodiments, the plurality of grooves 110 are formed of rubber in order to give a user more of a friction-like feel. However, it is contemplated that the plurality of grooves 110 may be formed from any elastomeric or polymer material. As illustrated in FIGS. 1 and 4-7, a first groove **110*a* extends circumferentially around the basketball 100 along a continuous, uninterrupted arch/line. The first groove 100*a* splits the basketball 100 in half along a first axis 130 of the basketball 100 (see FIGS. 4 and 5). As illustrated in FIGS. 4 and 5, the first groove 110*a* is substantially straight and does not comprise any curves or splines while circumnavigating the basketball 100**.

Referring to FIGS. 1-5, the basketball 100 comprises a second groove **110*b* that also extends circumferentially around the basketball 100 along a continuous, uninterrupted arch/line. The second groove 110***b* splits the basketball 100 in half along a second axis 132 of the basketball 100 (see FIGS. 4 and 5). Similar to the first groove 110*a*, the second groove 110*b* is substantially straight and does not comprise any curves or splines while circumnavigating the basketball 100. As illustrated in FIGS. 4 and 5, the first and second grooves 110*a*, 110*b* orthogonally intersect at a first intersection 120*a* and a second intersection 120*b* on the right and left sides of the basketball 100, respectively. The first and the second grooves 110*a*, 110*b* form right angles, i.e., are about 90° offset with each other, with respect to each other at the first and second intersections 120*a*, 120*b*. Further, as illustrated in FIGS. 4 and 5, the first and second grooves 110*a*, 110*b* split the basketball into four even sections or quadrants, I, II, III, IV.

Referring to FIGS. 1-7, the basketball 100 comprises a third groove 110*c* that curves around the outer portion 114 of the basketball 100. Unlike the first and second grooves 110*a*, 110*b*, the third groove 110*c* comprises various splines and curves that extend along all four of the quadrants I, II, III, IV of the basketball 100. Specifically, the third groove 110*c* snakes around the basketball 100 in a continuous loop, i.e., the third groove 110*c* is continuous and does not comprise any breaks. As illustrated in FIG. 4, the third groove 110*c* extends through the first groove 110*a* at a third intersection 120*c* and a fourth intersection 120*d*. As illustrated in FIG. 5, the third groove 110*c* extends through the second groove 110*b* at a fifth intersection 120*e* and a sixth intersection 120*f*. Unlike the first and second intersections 120*a*, 120*b*, the third, fourth, fifth, and sixth intersections 120*c*, 120*d*, 120*e*, 120*f* do not form right angles. Instead, the third groove 110*c* comprises a parabolic shape adjacent the third, fourth, fifth, and sixth intersections 120*c*, 120*d*, 120*e*, 120*f*. In particular, the third groove 110*c* forms a concave up parabola adjacent the third intersection 120*c* and a concave down parabola adjacent the fourth intersection 120*d* on the right side of the basketball 100, with reference to FIG. 4. Additionally, the third groove 110*c* forms a concave left parabola adjacent the fifth intersection 120*e* and a concave right parabola adjacent the sixth intersection 120*f* on the left side of the basketball 100, with reference to FIG. 5. As noted herein, the third groove 110*c* generally extends to the middle of each quadrant I, II, III, IV along its path around the basketball 100. Put differently, as illustrated in FIGS. 4 and 5, the third groove 110*c* extends to a point evenly between the first and second grooves 110*a*, 110*b* in each quadrant I, II, III, IV of the basketball 100. Although the basketball 100 only comprises three grooves 110*a*, 110*b*, 110*c*, it is contemplated that the basketball 100 can comprise a greater or fewer number of grooves 110 than shown. In some embodiments, the basketball 100 may comprise 1, 2, 3, 4, 5, 6, 7, 8, 9, or more grooves 110 bisecting each other and/or extending along the outer portion 114 of the basketball 100.

Referring to FIGS. 1-3, 6, and 7, the basketball 100 comprises one or more of logos, graphics, iconography 152 and text 154 positioned on the plurality of cover panels 112. The text 154 or iconography 152 may indicate to the user the manufacturer of the basketball 100 or the size and type of basketball 100. It is contemplated that the basketball 100 may comprise any number or type of iconography 152 or text 154 on the plurality of cover panels 112. In some embodiments, the iconography 152 and text 154 may be positioned on the plurality of grooves 110. Additionally, in alternative embodiments, the iconography 152 and text 154 may be placed at different positions on the basketball 100. Furthermore, in some embodiments, the basketball 100 may not comprise any iconography 152 or text 154 thereon.

Referring back to FIGS. 1-7, the basketball 100 may have a circumference conforming with one of the standard sizes attributable to such balls. For example, the basketball may be a "size 6" ball and comprise a circumference of about 28.5 inches (724 mm). In some embodiments, the basketball 100 may be a "size 7" ball and comprise a circumference of about 29.5 inches (749 mm). In some embodiments, the basketball may comprise a "size 5" ball with a circumference of about 27.5 inches (699 mm) or about 27.75 inches (705 mm). As noted herein, however, the circumference of the basketball 100 may be any size. For example, in some embodiments, the basketball 100 may comprise a circumference of between about 2 inches (51 mm) and about 100 inches (2540 mm), or about 10 inches (254 mm) and about 40 inches (1016 mm), or about 20 inches (508 mm) and about 35 inches (889 mm), or about 25 inches (635 mm) and about 31 inches (787 mm), or about 28.5 inches (724 mm), or about 29.5 inches (749 mm), or at least 2 inches (51 mm), or at least 10 inches (254 mm), or at least 20 inches (508 mm), or at least 25 inches (635 mm), or at least 28.5 inches (724 mm), or at least 29.5 inches (749 mm). In some embodiments, the basketball 100 may be a kids or youth sized basketball, such as a "size 4" ball. Therefore, as discussed above, the basketball 100 can comprise any size for all ages, genders, and/or users.

Referring still to FIGS. 1-7, the basketball 100 comprises substantially deeper and wider grooves than standard basketballs. As discussed above, the plurality of grooves 110 are formed of rubber for more of a friction-like feel. As such, the plurality of grooves 110 of the basketball 100 may be constructed and arranged to allow for a player that is training to be able to feel the plurality of grooves 110 better, which may create better fingertip control when transferring back to a normal, standard basketball. As will become more apparent upon further discussion herein, the basketball 100 may further comprise a highly contrasted color scheme such as, for example without limitation, a light on a dark color, which may help the player see the rotation of the ball via the plurality of grooves 110. For example, in some embodiments, the plurality of cover panels 112 may include primarily a dark color (shown with stipple shading in FIGS. 1-7 and 10) and the plurality of grooves 110 (shown without stipple shading om FIGS. 1-7 and 10) may include primarily a light color. As noted herein, any combination of colors may be used on the basketball 100. However, it is important that the color scheme includes the dark color on a majority of the basketball 100, e.g., the plurality of cover panels 112, and the light color on a smaller portion of the basketball, e.g., the plurality of grooves 110. Such a color scheme allows the user to easily see the rotation of the basketball 100 in the air. In preferred embodiments, the plurality of cover panels 112 comprise the color black and the plurality of grooves 110 comprise the color orange, however, it is contemplated that any color combination may be used as long as there is a clear contrast between the plurality of grooves 110 and the plurality of cover panels 112.

Figure 8:
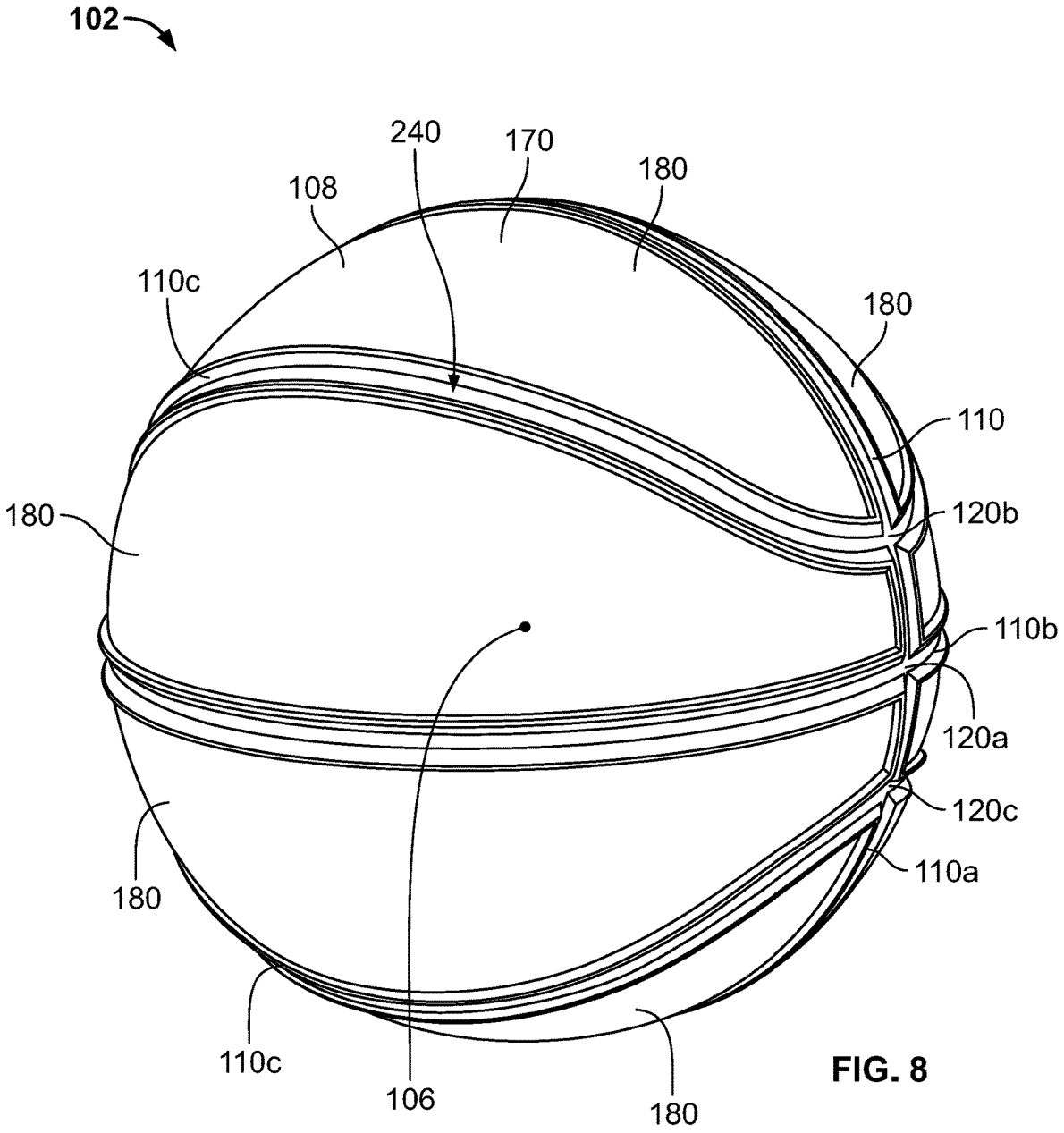
FIG. 8 is a front, top, and right perspective view of a carcass of the basketball of FIG. 1.
Figure 9:
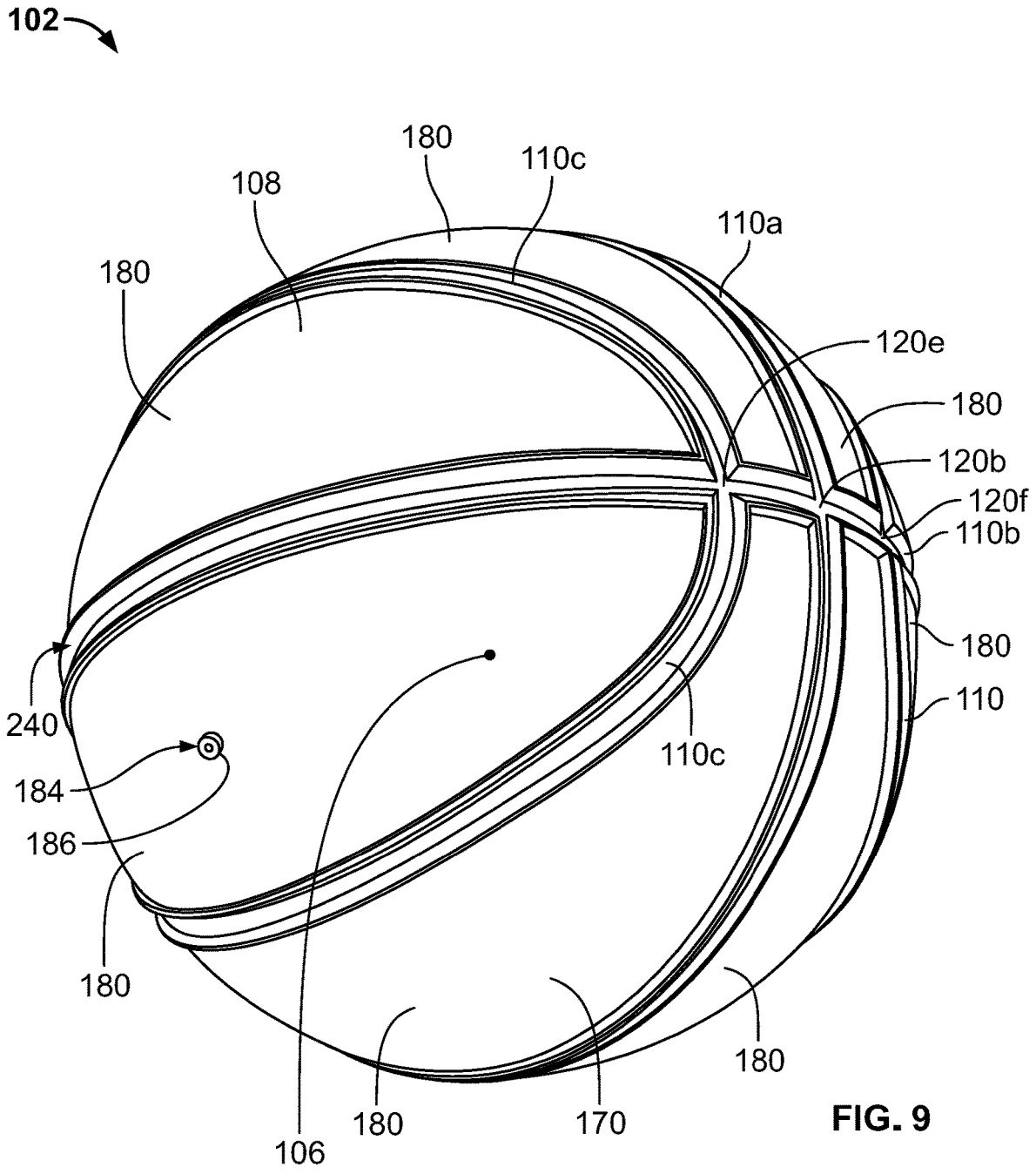
FIG. 9 is a bottom, left, and rear perspective view of the carcass of FIG. 8.

Referring to FIGS. 8 and 9, a front, top, and right side perspective view and a bottom, left, and rear perspective view of the carcass 102 are shown, respectively. As discussed above, the carcass 102 includes the bladder 108, the plurality of grooves 110, and threading (not shown). The bladder 108 of the carcass 102 is an inflatable air tube that comprises a generally spherical shape having an outer surface 170 and a central cavity (not shown) for retaining air therein. In some embodiments, the bladder 108 may be wrapped in the threading before the grooves 110 and the plurality of cover panels 112 are attached or molded thereto in order for the basketball 100 to maintain its shape. However, it is contemplated that the threading may be added after the plurality of grooves 110 are added to the bladder 108. In some embodiments, the threading is integrated within the bladder 108 during the molding operation. The bladder 108 enables the basketball 100 to retain a predetermined amount of air thereby achieving the desired air pressure within, or firmness to, the basketball 100. In some embodiments, the bladder 108 may be formed of any appropriate material, including multiple layers of the same or different material, such as a polymer, a plastic, a recycled material, and/or combinations thereof. In preferred embodiments, the bladder 108 is made of rubber or a rubber material. In some embodiments, the bladder 108 may be made of latex, butyle rubber, natural rubber, a synthetic polymeric plastic material, or other elastomeric materials.

As discussed above, once assembled, the carcass 102 may include threading (not shown) that is wrapped around the bladder 108 to strengthen the bladder 108 and keep it spherical and round. In other words, the threading completely covers the bladder 108 in order to keep the basketball 100 in proper shape. As will become more apparent upon further discussion herein, the threading may be attached to the bladder 108 by any suitable means or methods. As noted herein, the carcass 102 of the basketball 100 may comprise one or more threads. Therefore, the carcass 102 may comprise any number of threads. In preferred embodiments, the threading is formed of a high tensile strength material, such as nylon. In other embodiments, the threading may not be formed from nylon. Instead, the threading may be a textile, a wire, or another conventional thread material. In alternative embodiments, the threading may be formed through one or more segments of adhesive tape, or similar material.

Referring still to FIGS. 8 and 9, the plurality of grooves 110 are integral with the bladder 108. Put differently, the plurality of grooves 110 are integrally formed (or monolithically formed) in the outer surface 170 of the bladder 108, i.e., the plurality of grooves 110 and the bladder 108 form one element after they are molded together. As illustrated in FIGS. 8 and 9, the plurality of grooves 110 extend outwardly from the outer surface 170 of the bladder 108 as well as into the bladder 108 itself (see FIG. 12). As further illustrated in FIGS. 8 and 9, the carcass 102 comprises a plurality of recesses 180 disposed between the plurality of grooves 110. The plurality of recesses 180 are configured to receive the plurality of cover panels 112 that form the cover assembly 104. In preferred embodiments, the carcass 102 comprises eight recesses 180 positioned between the plurality of grooves 110. However, in some embodiments, the carcass 102 may comprise more or fewer recesses 180 than shown, depending on the number of grooves 110 present thereon. Thus, it is contemplated that the carcass 102 may comprise any number of recesses 180 and/or grooves 110.

Referring to FIG. 9, the bladder 108 comprises an opening or hole 184 extending through the outer surface 170 of the bladder 108. In particular, the hole 184 extends through the outer surface 170 the bladder 108 to the central cavity (not shown) of the bladder 108. Once assembled, the basketball 100 may comprise a plug 186 that is inserted into the hole 184 of the bladder 108. The plug 186 may be adhered to the bladder 108 by an adhesive and is provided for inflation of the bladder 108, and thus, the basketball 100. Any type of adhesive may be used to secure the plug 186 within the hole 184 of the bladder 108.

Referring back to FIGS. 1-7, the plurality of cover panels 112 are attached to the bladder 108 (see FIGS. 8 and 9) and define the cover assembly 104. As illustrated in FIGS. 1-7, the cover assembly 104 comprises 8 cover panels 112. However, as discussed above, the cover assembly 104 may comprise a greater or fewer number of cover panels 112. For example, the cover assembly 104 may comprise 2, 4, 6, 8, 10, 12, 14, or more cover panels 112. In some embodiments, the basketball 100 may comprise one groove 110 positioned between two cover panels 112. As outlined above, the plurality of cover panels 112 are situated between each of the plurality of grooves 110. The plurality of cover panels 112 are single or multi-layered sheets of material that are coupled to and positioned within the recesses 180 of the bladder 108. As will be discussed in further details herein, the cover panels 112 are secured to the bladder 108 by an adhesive that bonds the cover panels 112 to the recesses 180 of the bladder 108. Once the cover panels 112 are adhered to the bladder 108, the bladder 108 and cover panels 112 are heat molded to hold everything together and finalize the basketball 100. In some embodiments, the cover panels 112 can be attached to the bladder 108 (see FIGS. 8 and 9) by other means, such as, for example, stitching molding, pressing, bonding, stitching, stapling, and any combination thereof. In other embodiments, the cover panels 112 may be laminated to the recesses 180 of the bladder 108.

Referring still to FIGS. 1-7, the cover panels 112 comprise an outer surface 202 and each the plurality of cover panels 112 includes a middle region 204 and a peripheral region 206 with peripheral edges 208 that extend to the grooves 110. As will be discussed in further detail herein, the outer surface 202 of the peripheral regions 206 of each of the cover panels 112 are recessed, i.e., closer to the center point 106 of the basketball 100, from the outer surface 202 of the middle regions 204 (see FIG. 11). Put differently, a thickness 220 of the cover panels 112 tapers from the middle region 204 to the peripheral edges 208 in the peripheral regions 206 of the plurality of cover panels 112 (see FIG. 12). As noted herein, the peripheral regions 206 begin as soon as the thickness 220 of the cover panels 220 begin to taper or decrease (see contour lines in FIGS. 1-7). The cover assembly 104 is configured for impact with one or more playing surfaces and for contact with players. In some embodiments, the cover panels 112 may be formed of one or more layers. In preferred embodiments, the plurality of cover panels 112 are made of a microfiber composite leather. However, it is contemplated that the cover panels 112 may be formed from any suitable material. As illustrated in FIGS. 1-7 and 10, the plurality of cover panels 112 are depicted with a stipple shading. The stippling in FIGS. 1-7 and 10 illustrate a contrast to other portions of the figures (such as the plurality of grooves 110), but is not limited to a specific color, material, and/or texture. Therefore, the stippling in FIGS. 1-7 and 10 is used to differentiate the plurality of grooves 110 and the carcass 102 and is used for illustrative purposes.

Figure 10:
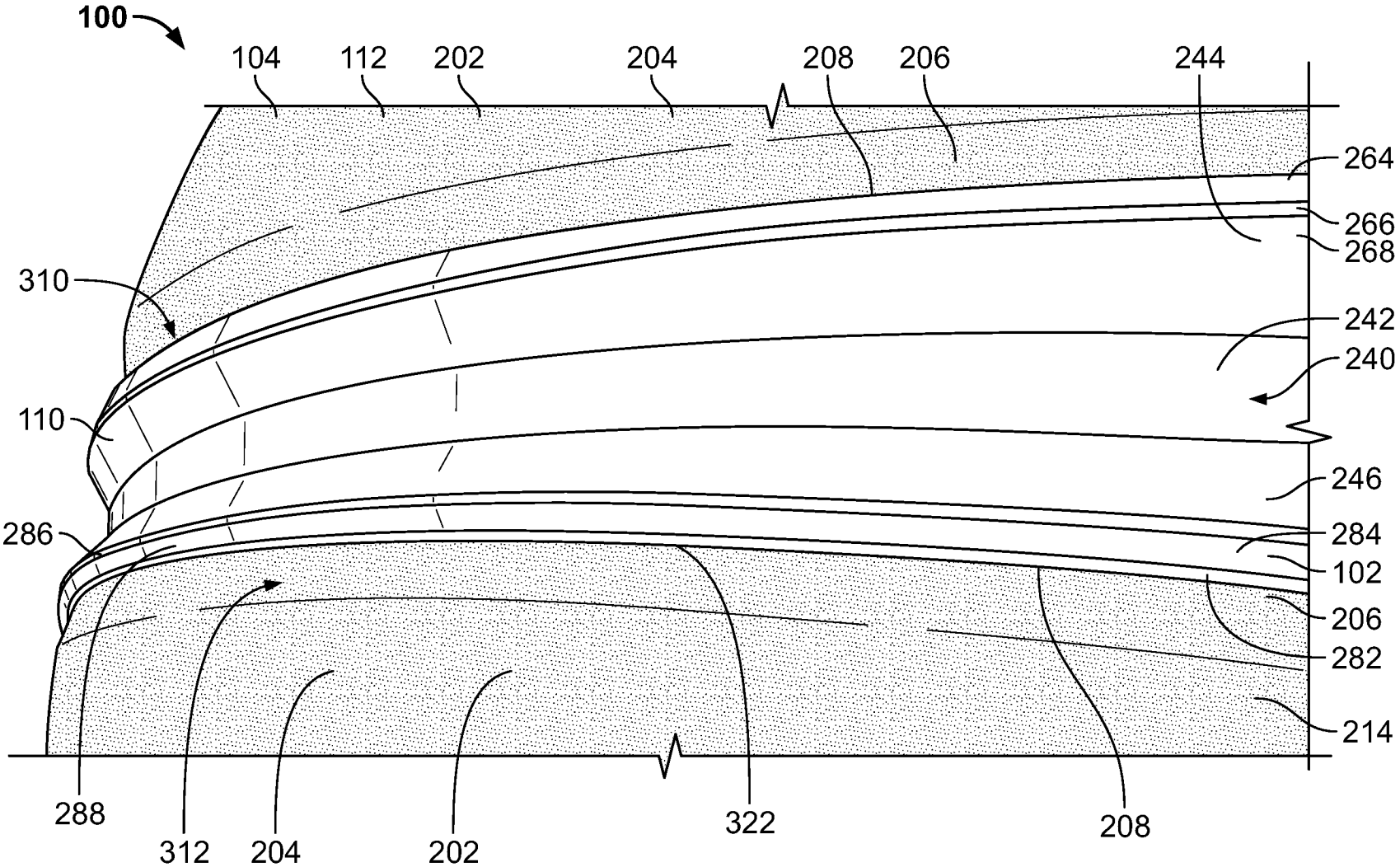
FIG. 10 is a zoomed in perspective view of a groove of the basketball of FIG. 1.

Referring to FIG. 10, a zoomed in perspective view of one of the grooves 110 is shown. As illustrated in FIG. 10, the groove 110 is sandwiched or positioned between the peripheral edges 208 of two cover panels 112. While the present embodiment includes three grooves 110*a*, 110*b*, 110*c* situated on the basketball, the same reference numbers apply to like elements of each of the grooves 110*a*, 110*b*, 110*c* as described hereinafter below. As such, only a single groove 110 is described and referred to herein, however, the grooves 110*a*, 110*b*, 110*c* are identical, and the description of one relates to the description of the others.

Figure 11:
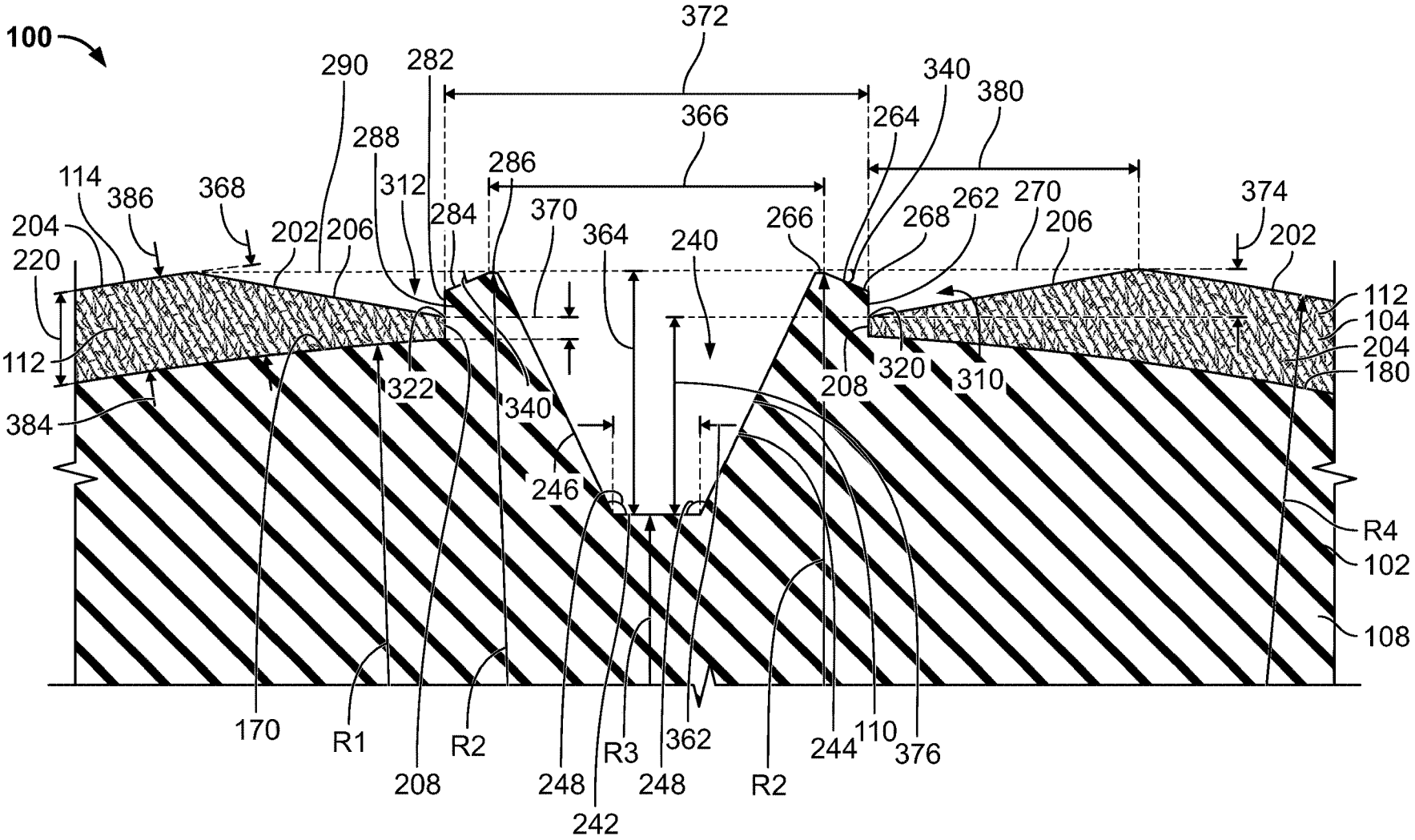
FIG. 11 is a cross-sectional view of the groove of the basketball of FIG. 1.

Referring to FIG. 11, a cross-sectional view of one of the grooves 110 of the basketball 100 is shown. As illustrated in FIG. 11, the groove 110 comprises a central channel 240 disposed within the center of the groove 110. The central channel 240 is defined by a bottom wall 242 having a first end and a second end opposite the first end, a first side wall 244, and a second side wall 246 of the groove 110. The first side wall has a first end coupled with the first end of the bottom wall and a second end opposite the first end. The second side wall has a first end coupled with the second end of the bottom wall and a second end opposite the first end. The bottom wall 242 of the groove 110 is substantially flat in cross section and extends circumferentially along the basketball 100. In other words, the distance between the bottom wall 242 of the groove 110 and the center point 106 (see FIGS. 1-7) of the basketball 100 is always substantially the same. However, in some embodiments, the distance between the bottom wall 242 of the groove 110 and the center point 106 (see FIGS. 1-7) of the basketball 100 may change throughout the groove 110. As further illustrated in FIG. 11, the first and second side walls 244, 246 extend from the bottom wall 242 of the groove 110 at a side wall angle 248. Put differently, the first and second side walls 244, 246 are angled with respect to the bottom wall 242 of the groove 110. In preferred embodiments, the side wall angle 248 is greater than 90°. However, in some embodiments, the side wall angle 248 is greater than 45° or greater than 80°, or greater than 100°, or greater than 105°.

Referring still to FIG. 11, the first and second side walls 244, 246 are substantially flat or linear when viewed in cross-section. As illustrated in FIG. 11, the bottom wall 242, the first side wall 244, and the second side wall 246 create a generally trapezoidal shape in the central channel 240. In some embodiments, the central channel 240 may comprise a different shape. For example, the central channel 240 may comprise a U-shape, V-shape, W-shape, frustoconical shape, a square shape, or a parabolic shape. As noted herein, the first and second side walls 244, 246 are mirror images of each other. In some embodiments, the first side wall 244 may extend higher, farther, or lower than the second side wall 246, and vice versa. Further, in other embodiments, the side wall angle 248 of the first side wall 244 may be different than the side wall angle 248 of the second side wall 246.

Referring still to FIG. 11, the groove 110 comprises a first outer wall 262 that extends outwardly from the outer surface 170 of the bladder 108. The first outer wall 262 extends radially away from the center point 106 of the basketball 100 and is connected to a first upper wall 264. In some embodiments, the first outer wall 262 is substantially vertical in cross-section. The first upper wall 264 is angled upward and inwardly toward the central channel 240 of the groove 110 with respect to the first outer wall 262. Further, the first side wall 244 and the first upper wall 264 are connected by a first ridge 266. The first ridge 266 is a generally flat surface (in cross-section) that extends substantially parallel with the bottom wall 242 of the groove 110. As noted herein, the first side wall 244, the first outer wall 262, the first upper wall 264, and the first ridge 266 define a first rib 268 of the groove 110. Put differently, the first rib 268 includes the first side wall 244, the first outer wall 262, the first upper wall 264, and the first ridge 266. As illustrated in FIG. 11, the first ridge has a first end coupled with the second end of the first side wall and a second end opposite the first end, the first upper wall having a first end coupled with the second end of the first ridge and a second end opposite the first end and a first outer wall having a first end coupled with the second end of the first upper wall and a second end opposite the first end. As illustrated in FIG. 11, the first rib 268 of the groove 110 extends outwardly from the bladder 108 and the first ridge 266 of the first rib 268 is generally aligned (along a straight line 270) with an end of the middle region 204 of the cover panels 112. In some embodiments, the distance from the center point 106 (see FIGS. 1-7) of the basketball 100 to the first ridge 266 of the first rib 268 is substantially the same as the distance from the center point 106 (see FIGS. 1-7) of the basketball 100 to the outer surface 202 of the middle region 204 of the cover panels 112. In preferred embodiments, the distance from the center point 106 (see FIGS. 1-7) of the basketball 100 to the first ridge 266 of the first rib 268 is smaller than the distance from the center point 106 (see FIGS. 1-7) of the basketball 100 to the outer surface 202 of the middle region 204 of the cover panels 12.

Referring still to FIG. 11, the groove 110 comprises a second outer wall 282 that extends outwardly from the outer surface 170 of the bladder 108. The second outer wall 282 extends radially away from the center point 106 (see FIGS. 1-7) of the basketball 100 and is connected to a second upper wall 284. In some embodiments, the second outer wall 282 is substantially vertical in cross-section. The second upper wall 284 is angled upward and inwardly toward the central channel 240 of the groove 110 with respect to the second outer wall 282. The second side wall 246 and the second upper wall 284 are connected by a second ridge 286. The second ridge 286 is a generally flat surface (in cross-section) that extends substantially parallel with the bottom wall 242 of the groove 110. As noted herein, the second side wall 246, the second outer wall 282, the second upper wall 284, and the second ridge 286 define a second rib 288 of the groove 110. Put differently, the second rib 288 includes the second side wall 246, the second outer wall 282, the second upper wall 284, and the second ridge 286. The second rib 288 of the groove 110 extends outwardly from the bladder 108 and the second ridge 286 of the second rib 288 is generally aligned (along a straight line 290) with the end of the middle region 204 of the cover panels 112. As illustrated in FIG. 11, the second ridge has a first end coupled with the second end of the second side wall and a second end opposite the first end, the second upper wall has a first end coupled with the second end of the second ridge and a second end opposite the first end and the second outer wall has a first end coupled with the second send of the second upper all and a second end opposite the first end. As illustrated in FIG. 11, the second ridge 286 of the second rib 288 is aligned (along a substantially straight line) with the first ridge 266 of the first rib 268. However, in alternative embodiments, the second ridge 286 and the first ridge 266 may not be aligned. In some embodiments, the distance from the center point 106 (see FIGS. 1-7) of the basketball 100 to the second ridge 286 of the second rib 288 is substantially the same as the distance from the center point 106 (see FIGS. 1-7) of the basketball 100 to the outer surface 202 of the middle region 204 of the cover panels 112. In preferred embodiments, the distance from the center point 106 (see FIGS. 1-7) of the basketball 100 to the second ridge 286 of the second rib 288 is smaller than the distance from the center point 106 (see FIGS. 1-7) of the basketball 100 to the outer surface 202 of the middle region 204 of the cover panels 112.

Referring still to FIG. 11, the bottom wall 242 of the groove 110 is positioned between the first rib 268 and the second rib 288. As such, the central channel 240 of the groove 110 is disposed between the first rib 268, the second rib 288, and the bottom wall 242. In preferred embodiments, the second rib 288 is a mirror image of the first rib 268. Otherwise, the first and second ribs 268, 288 are substantially identical. Thus, as noted herein, the first outer wall 262 and the second outer wall 282, the first upper wall 264 and the second upper wall 284, the first side wall 244 and the second side wall 246, and the first ridge 266 and the second ridge 286 are substantially the same. The only difference lies in the direction and angle of the first and second upper walls 264, 284 and the first and second side walls 244, 246. However, in some embodiments, the first and second ribs 268, 288 may not be the same (or a mirror image of the other) and may comprise different characteristics that differ from one another. For example, the first and second outer wall 262, 282, the first and second upper walls 264, 284, the first and second ridges 266, 286, and the first and second side walls 244, 246 may extend to different lengths or comprise different angles than their counterparts. In some embodiments, the first and second outer walls 262, 282 are substantially parallel. As illustrated in FIG. 11, each of the first and second side walls 244, 246, the first and second outer walls 262, 282, the first and second upper walls 264, 284, the first and second ridges, 266, 286, and the bottom wall 242 are all connected at angled corners. In some embodiments, one or more of the first and second side walls 244, 246, the first and second outer walls 262, 282, the first and second upper walls 264, 284, the first and second ridges, 266, 286, and the bottom wall 242 may be connected to each other by a rounded corner and/or a chamfered edge or corner. Therefore, the conners on the first and second ribs 268, 288 may be less sharp and more rounded.

Referring still to FIG. 11, the peripheral regions 206 of the cover panels 112 and the first rib 268 define a first side channel or depression 310 and the peripheral regions 206 of the cover panels 112 and the second rib 288 define a second side channel or depression 312. Put differently, each of the plurality of grooves 110 comprises the first side channel 310 between the first rib 268 and the middle region 204 of one of the plurality of cover panels 112 and the second side channel 312 between the second rib 288 and the middle region 204 of a different or second cover panel 112. The first and second side channels 310, 312 are formed as a result of the cover panels 112 tapering in the peripheral regions 206. Therefore, the groove 110 forms at least three channels within the basketball 100, i.e., the central channel 240, the first side channel 310, and the second side channel 312. As illustrated in FIG. 11, the first side channel 310 is a mirror image of the second side channel 312. As further illustrated in FIG. 11, the first outer wall 262 and the second outer wall 282 abut the peripheral edges 208 of the cover panels 112 at a first valley 320 and a second valley 322, respectively. As noted herein, the first and second upper walls 264, 284 define an upper wall angle 340. In some embodiments, the upper wall angle 340 can be larger than shown (see FIG. 12). In preferred embodiments, the upper wall angle 340 can be between about 1° and about 80°. However, it is contemplated that the upper wall angle 340 can be any degree.

Referring to FIGS. 1 and 11, the basketball 100 defines a first radius R1 from the center point 106 of the basketball 100 to the outer surface 170 of the bladder 108 (surface defining the recesses 180), the basketball 100 defines a second radius R2 from the center point 106 of the basketball 100 to the first and/or second ridges 266, 286, and the basketball 100 defines a third radius R3 from the center point 106 of the basketball 100 to the bottom wall 242 of the groove 110. As illustrated in FIG. 11, the difference between the first radius and the third radius (R1-R3) is bigger than the difference between the second radius and first radius (R2-R1). Further, the basketball 100 defines a fourth radius R4 from the center point 106 of the basketball 100 to the outer surface 202 of the middle region 204 of the cover panels 112. As noted herein, the fourth radius R4 is larger than the second radius R2.

Referring still to FIG. 11, the bottom wall 242 defines a bottom wall length 362 and the central channel 240 of the groove 110 defines a channel depth 364. In preferred embodiments, the bottom wall length 362 of the bottom wall 242 of the groove 110 may be between about 0.01 mm and about 10 mm, or about 1 mm and 5 mm, or about 2 mm and 4 mm, or about 3 mm, or at least 0.01 mm, or at least 1 mm, or at least 2 mm, or at least 3 mm, or at least 3.5 mm, or at least 4 mm. In some embodiments, the channel depth 364 of the central channel 240 of the groove 110 may be between about 0.5 mm and about 15 mm, or about 1 mm and about 5 mm, or about 3 mm and about 4 mm, or about 3.5 mm, or at least 0.5 mm, or at least 1 mm, or at least 2 mm, or at least 3 mm, or at least 3.5 mm, or at least 4 mm.

Referring still to FIG. 11, the groove 110 defines a ridge distance 366 between outer portions of the first and second ridges 266, 286. In some embodiments, the ridge distance 366 of the groove 110 may be between about 1 mm and about 30 mm, or about 7 mm and about 15 mm, or about 10 mm and about 12 mm, or about 11 mm, or at least 1 mm, or at least 7 mm, or at least 10 mm, or at least 11 mm, or at least 12 mm.

Referring still to FIG. 11, the middle region 204 of the cover panels 112 comprises a middle region thickness 368 and the peripheral edges 208 of the cover panels 112 comprises a peripheral edge thickness 370. In some embodiments, the middle region thickness 368 of the cover panels 112 may be between about 0.5 mm and about 10 mm, or about 1 mm and about 6 mm, or about 2 mm and about 4 mm, or about 3 mm, or at least 0.5 mm, or at least 1 mm, or at least 2 mm, or at least 3 mm, or at least 4 mm. In some embodiments, the peripheral edge thickness 370 of the cover panels 112 may be between about 0.1 mm and about 5 mm, or about 0.3 mm and about 1 mm, or about 0.6 mm and about 0.8 mm, or about 0.7 mm, or at least 0.1 mm, or at least 0.3 mm, or at least 0.6 mm, or at least 0.7 mm, or at least 0.8 mm. As discussed above, in preferred embodiments, the middle region thickness 368 is thicker than the peripheral edge thickness 370.

Referring still to FIG. 11, the groove 110 defines an outer wall distance 372 between the first and second outer walls 262, 282. In some embodiments, the outer wall distance 372 between the first and second outer walls 262, 282 may be between about 2 mm and about 25 mm, or about 10 mm and about 18 mm, or about 13 mm and about 15 mm, or about 14 mm, or at least 2 mm, or at least 10 mm, or at least 13 mm, or at least 14 mm, or at least 15 mm.

Referring still to FIG. 11, the groove 110 defines an upper rib height 374 between the first and second valleys 320, 322 (or a top edge of the peripheral edges 208 of the cover panels 112) and the first and second ridges 266, 286, and an inner rib depth 376 between the first and second valleys 320, 322 (or a top edge of the peripheral edges 208 of the cover panels 112) and the bottom wall 242. In some embodiments, the upper rib height 374 of the groove 110 may be between about 0.1 mm and about 10 mm, or about 0.5 mm and about 5 mm, or about 1 mm and about 2 mm, or about 1.5 mm, or at least 0.1 mm, or at least 0.5 mm, or at least 1 mm, or at least 1.5 mm, or at least 2 mm. In some embodiments, the inner rib depth 376 of the groove 110 may be between about 1 mm and about 10 mm, or about 2 mm and about 6 mm, or about 4 mm and about 5 mm, or about 4.5 mm, or at least 1 mm, or at least 2 mm, or at least 4 mm, or at least 4.5 mm, or at least 5 mm.

Referring still to FIG. 11, the first and second side channels 310, 312 define a side channel width 380. In some embodiments, the side channel width 380 of the first and second side channels 310, 312 may be between about 0.5 mm and about 8 mm, or about 1 mm and about 4 mm, or about 2 mm and about 3 mm, or about 2.5 mm, or at least 0.5 mm, or at least 1 mm, or at least 2 mm, or at least 2.5 mm, or at least 3 mm.

Referring still to FIG. 11, the bladder 108 defines a bladder diameter 384 and the middle region 204 of the plurality of cover panels 112 defines a cover panel diameter 386 (the cover panel diameter 386 taken from outer surfaces 202 of the middle regions 204 of the plurality of cover panels 112). In some embodiments, the bladder diameter 384 may be between about 50 mm and about 500 mm, or about 150 mm and about 350 mm, or about 200 mm and about 300 mm, or about 236 mm, or at least 50 mm, or at least 150 mm, or at least 200 mm, or at least 236 mm, or at least 300 mm. In some embodiments, the cover panel diameter 386 may be between about 50 mm and about 500 mm, or about 150 mm and about 350 mm, or about 200 mm and about 300 mm, or about 242, or at least 50 mm, or at least 150 mm, or at least 200 mm, or at least 242 mm, or at least 300 mm. As noted herein, all ranges disclosed within this application are inclusive of the outer bounds of the range.

As discussed above, the basketball 100 can include various sizes and circumferences. In some embodiments, the basketball 100 may be scaled down or up from the dimensions disclosed herein depending on the size. In particular, the plurality of grooves 110 and the areas adjacent the plurality of grooves 110 may be scaled down or up depending on the size of the basketball 100. Therefore, all of the ranges described above may be scaled down or up depending on the size of the basketball 100. Alternatively, in some embodiments, the plurality of grooves 110 and the areas adjacent the plurality of grooves 110 may not be scaled down or up from the dimensions disclosed herein depending on the size of the basketball 100. Instead, the plurality of grooves 110 and the areas adjacent the plurality of grooves 110 may be the same size no matter the dimension of the basketball 100, e.g., youth/kids basketballs and adult basketballs will have the same size grooves 110 or substantially the same size grooves 110, as outlined above. In preferred embodiments, the basketball 100 may comprise a 29.5 inch (749 mm) circumference or a 28.5 inch (724 mm) circumference and use the ranges outlined above, i.e., the 29.5 inch (749 mm) and the 28.5 inch (724 mm) circumference basketballs 100 have the same or substantially the same size grooves 110.

Figure 12:
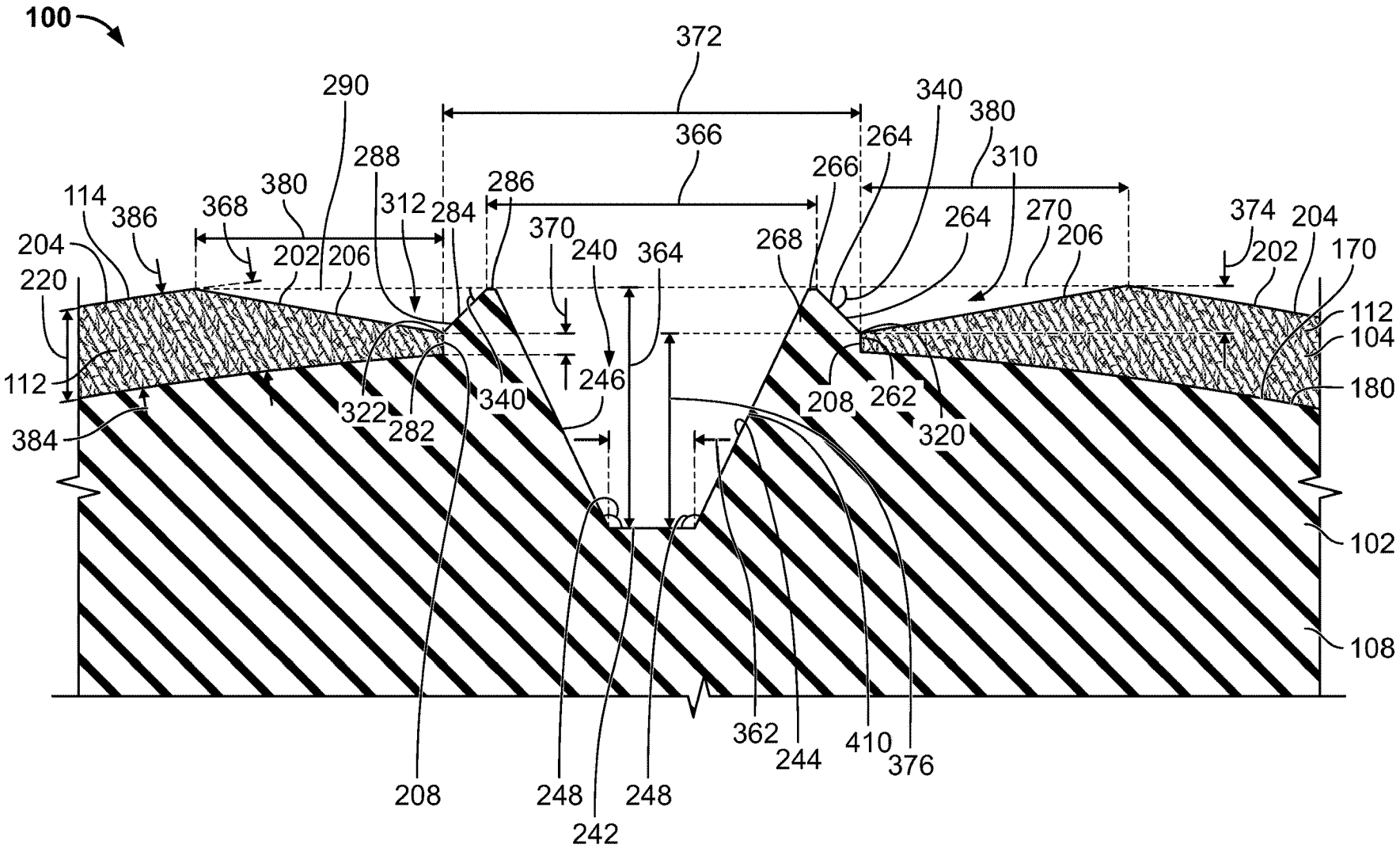
FIG. 12 is a cross-sectional view of another embodiment of a groove of a basketball.

Referring to FIG. 12, like reference numbers are used with regard to an alternative embodiment of a groove 410 of the basketball 100. As noted herein, the groove 410 is substantially similar to the plurality of grooves 110 discussed above except for a few differences, which will be explained in detail below. As illustrated in FIG. 12, the upper wall angle 340 of the first and second upper walls 264, 284 of the groove 410 is larger than the upper wall angle 340 shown in FIG. 11. In some embodiments, the upper wall angle 340 of the groove 410 may be between about 20° and about 70°, or about 30° and about 60°, or about 50° and about 60°, or at least 20°, or at least 30°, or at least 40°, or at least 50°. As a result of the upper wall angle 340 being greater, the first and second upper walls 264, 284 of the groove 410 comprise a steeper slope than the first and second upper walls 264, 284 of the groove 110 (see FIG. 11). Further, since the upper wall angle 340 is greater in this embodiment, the first outer wall 262 and the second outer wall 282 are smaller in FIG. 12. In some embodiments, the first and second outer walls 262, 282 may be the same length as the peripheral edge thickness 370. Put differently, the first and second outer walls 262, 282 may protrude out of the bladder 108 to a height substantially the same as the peripheral edges 208 of the cover panels 112.

Referring still to FIG. 12, the first side channel 310 and the second side channel 312 are altered because of the upper wall angle 340 of the first and second upper walls 264, 284. As illustrated in FIG. 12, in some embodiments, the first and second side channels 310, 312 may comprise a generally checkmark shape. As noted herein, the groove 410 of FIG. 12 comprises a less pronounced or more gradual incline along the first and second ribs 268, 288, than the groove 110 of FIG. 11.

As discussed above, the basketball 100 comprises a generally spherical shape. Therefore, even though some surfaces look horizontal, vertical, and/or planer in FIGS. 11 and 12, in reality, the surfaces will extend circumferentially around the basketball 100 and may not be horizontal, vertical, and/or planer when viewed outside of the cross-sections. Thus, as noted herein, the descriptions, i.e., vertical, horizontal, parallel, etc., used in FIGS. 11 and 12 references the groove 110 in cross-section and may not apply if referencing the structure outside the cross-sections.

Figure 13:
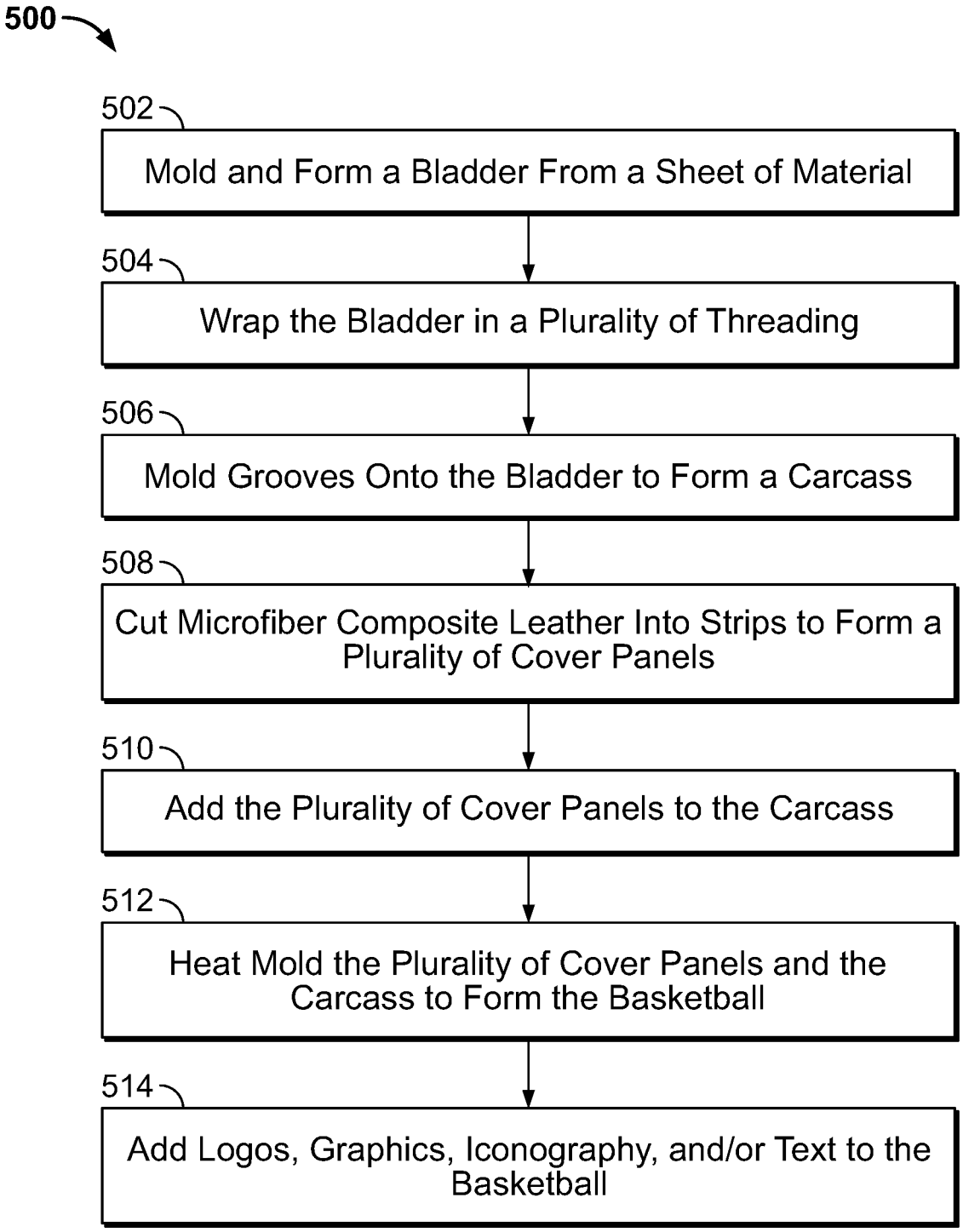
FIG. 13 is a flowchart depicting an example process for a method of manufacturing the basketball of FIG. 1.

Referring to FIG. 13, a flowchart outlining the steps of a process 500 for forming the basketball 100 illustrated in FIGS. 1-7 and outlined above is shown, according to one example. In this example embodiment, the bladder 108 of the carcass 102 is formed (see FIGS. 8 and 9), and the bladder 108 and the plurality of cover panels 112 are used to form the basketball 100 (see FIG. 11). While the example process is described with reference to the flowchart illustrated in FIG. 13, many other methods of forming the basketball 100 may alternatively be used. For example, the order of execution of the blocks may be rearranged, changed, eliminated, and/or combined to perform the process 500.

At step 502, the bladder 108 is molded and formed from a sheet of material. The bladder 108 may be made of any suitable material by any suitable process. As discussed above, in preferred embodiments, the bladder 108 may be molded and formed from a sheet (or multiple sheets) of natural rubber. As noted herein, the bladder 108 may be formed in any molding operation. In some embodiments, to form the bladder 108, the sheet of natural rubber may be pressed to cut the shape of the ball. Depending on the size of the basketball 100, the diameter of the bladder 108 may be altered. As discussed above, the bladder 108 may be formed with the hole 184 therein (see FIG. 9). Once the bladder 108 is formed, the bladder 108 may be wrapped in the layer of threading (not shown), at step 504. The plurality of threading may be wrapped around the bladder 108 by any suitable means or method. As discussed above, the threading is designed to cover the outer surface 170 of the bladder 108 (see FIGS. 8 and 9), and the threading strengthens the bladder 108 and keeps it round.

After the threading is wrapped around the bladder 108, at step 506, the bladder 108 is molded to form the plurality of grooves 110, 410 therein. Once the plurality of grooves 110, 410 are molded onto the bladder 108, the carcass 102 is formed (see FIGS. 8 and 9). As discussed above, the plurality of grooves 110, 410 may be formed of rubber for better friction and grip by the user. The plurality of grooves 110, 410 may be added via any molding operation or method. As noted herein, steps 502, 504, 506 create the carcass 102 of the basketball. In some embodiments, steps 502, 504, 506 may be done in a single mold or a single operation. Therefore, the carcass 102 may be formed efficiently through one single or multistep molding process. In some embodiments, the bladder 108 may be molded, wrapped in the threading, and then molded again to form the grooves 110, 410 therein. Further, in some embodiments, the plurality of grooves 110, 410 may be added before the bladder 108 is wrapped in threading. Therefore, the carcass 102 may be formed in any order or variation of steps 502, 504, 506. In some embodiments, the bladder 108 may be purchased prewrapped in threading and then molded to add the grooves 110, 410 thereon. Further, as discussed above, an additional layer of rubber or an elastomeric material (or polymer material) may be added to the bladder 108 while forming the plurality of grooves 110, 410 thereon. Thus, the threading may be encased in the bladder 108 and may not be visible once the carcass 102 is formed. As further discussed above, once the carcass 102 is formed, the plug 186 may be added and secured to the hole 184 of the bladder 108 by any suitable adhesive (see FIG. 9). The plug 186 is provided for inflating the bladder 108.

Referring still to FIG. 13, at step 508, a microfiber composite leather is cut into strips to form the plurality of cover panels 112 of the basketball 100. As discussed above, the plurality of cover panels 112 form the cover assembly 104 and are attached to the carcass 102 between the plurality of grooves 110, 410. Therefore, the microfiber composite leather is cut into strips of specific size to fit between the plurality of grooves 110, 410. As noted herein, step 508 does not need to be performed after the carcass 102 is formed at step 506. Instead, while the carcass 102 is being formed, i.e., steps 502, 504, 506, the microfiber composite leather may be cut into strips. Therefore, step 508 can be proceeding simultaneous to steps 502, 504, 506. Thus, once the carcass 102 is formed, the microfiber composite leather strips would be ready to be attached thereto. In some embodiments, the microfiber composite leather may be cut from a sheet of leather. As discussed above, it is contemplated that the plurality of cover panels 112 may be formed from any type of leather or material. Therefore, the plurality of cover panels 112 are not limited to just microfiber composite leather.

Once the microfiber composite leather is cut into strips to form the plurality of cover panels 112, the plurality of cover panels 112 are added to the carcass 102 at step 510. As discussed above, the plurality of cover panels 112 are positioned within the plurality of recesses 180 of the carcass 102 and adhered thereto. In some embodiments, the plurality of cover panels 112 are glued to the recesses 180 of the carcass 102. However, it is contemplated that any type of adhesive may be used to adhere the plurality of cover panels 112 to the plurality of recesses 180 of the carcass 102. As illustrated in FIG. 13, at step 512, the plurality cover panels 112 and the carcass 102 are heat molded together to form the basketball 100. The mold compresses the plurality of cover panels 112 to the carcass 102 and, thus, bonds the microfiber composite leather strips to the carcass 102 to finalize the basketball 100. In some embodiments, a bonding chamber may be used to create the basketball 100. Further, in some embodiments, the plurality of cover panels 112 may not be attached to the carcass 102 by an adhesive before the plurality of cover panels 112 and the carcass 102 are molded together. Instead, the plurality of cover panels 112 may be simply positioned within the plurality of recesses 180 of the carcass 102 without an adhesive and then placed in the heat mold to bond together. Finally, once the basketball 100 is formed, the logos, graphics, iconography 152, and/or text 154 may be engraved or added to the basketball 100 at step 514. As discussed above, the logos, graphics, iconography 152, and/or text 154 may be added to the plurality of cover panels 112 or the grooves 110, 410. In some embodiments, the logos, graphics, iconography 152, and/or text 154 may be added to the microfiber composite leather strips, i.e., the cover panels 112, before they are cut and/or heat molded to the carcass 102.

As outlined above, the basketball 100 of the present invention comprises substantially deeper and wider grooves 110, 410 than any previous standard basketball. The plurality of grooves 110, 410 of the basketball 100 are constructed and arranged to allow for a player that is training to be able to feel the grooves 110, 410 better since they are more elaborate and dramatic than typical basketballs, which may create better fingertip control when transferring back to a normal basketball. As discussed above, the basketball 100 may further comprise a highly contrasted color scheme, which may help the player see the rotation of the basketball 100 via the plurality of grooves 110, 410. Put differently, since the majority of the basketball 100, e.g., the plurality of cover panels 112, comprises a dark color and the plurality of grooves 110, 410 comprise a light color, the user will be able to clearly see and visualize the rotation of the basketball 100, via the plurality of grooves 110, 410, while shooting or passing the basketball 100. As further discussed above, the basketball 100 is not limited to one particular color scheme. Instead, the basketball 100 may comprise any type of color scheme as long as there is a high contrast in color between the plurality of grooves 110, 410 and the plurality of cover panels 112. The high contrast, highly visible color pairing allows the user to be able to more distinctly view the plurality of grooves 110, 410.

The basketball 100 of FIGS. 1-7 provides an improved basketball and teaching method over conventional basketballs. Prior to the development of the basketball 100, the only way to teach backspin and fingertip control was verbally and visually. With the basketball 100 and method of the present invention, players may now be able to feel and see for themselves exactly what is needing to be taught. The basketball 100, and inventive learning and teaching process of the present invention, provides self-explanatory, simple and effective ways to train and instruct. Therefore, the basketball 100 has the ability to make the job of a trainer less stressful while teaching these concepts because the user (or player) may get a better feel of the concept.

In summary, the basketball 100 comprises deeper and wider grooves 110, 410 and a reversed color scheme for visual rotation of the basketball 100. The basketball 100 allows the user to have a tangible item that will teach them how to find the plurality of grooves 110, 410 of the basketball 100 and better see the rotation that the individual applies to the ball. As discussed above, this may be accomplished through having larger and more dramatic groove 110, 410 to better help the individual that is practicing find the center of the groove 110, 410 over and over again with practice. One should take the ball and properly place their fingers in the groove 110, 410, both off the catch and off the dribble, to help this process be trained and engrained within their muscle memory. Additionally, the color of the grooves 110, 410 will create a high-end visual representation of the backspin and rotation that is put onto the basketball 100.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to sporting equipment of the type specifically shown. Still further, aspects of the basketball of any of the embodiments disclosed herein may be modified to work with any type of sporting product or athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

We claim:

1. A basketball, comprising:

a carcass including a plurality of recesses disposed between a plurality of grooves;

a cover assembly including a plurality of cover panels positioned within the recesses; and each of the plurality of grooves comprising a central channel, wherein the central channel is defined by a bottom wall having a first end and a second end opposite the first end, a first side wall having a first end coupled with the first end of the bottom wall and a second end opposite the first end, and a second side wall having a first end coupled with the second end of the bottom wall and a second end opposite the first end, and wherein the first and second side walls are substantially planar, wherein each of the plurality of grooves includes a first ridge having a first end coupled with the second end of the first side wall and a second end opposite the first end, a second ridge having a first end coupled with the second end of the second side wall and a second end opposite the first end, a first upper wall having a first end coupled with the second end of the first ridge and a second end opposite the first end, a second upper wall having a first end coupled with the second end of the second ridge and a second end opposite the first end, a first outer wall having a first end coupled with the second end of the first upper wall and a second end opposite the first end, and a second outer wall having a first end coupled with the second end of the second upper wall and a second end opposite the first end, wherein the central channel defines a channel depth of between about 3 mm and about 4 mm, wherein each of the plurality of grooves defines a ridge distance of between about 10 mm and about 12 mm, wherein an entirety of the bottom wall is substantially flat, the first side wall extends upwardly away from the first end of the bottom wall at an obtuse angle relative to the bottom wall, and the second side wall extends upwardly away from the second end of the bottom wall at the obtuse angle relative to the bottom wall, wherein the first upper wall extends downwardly away from the second end of the first ridge toward the carcass, and the second upper wall extends downwardly away from the second end of the second ridge toward the carcass, and wherein the first outer wall extends downwardly away from the second end of the first upper wall substantially perpendicular to the bottom wall, and the second outer wall extends downwardly away from the second end of the second upper wall substantially perpendicular to the bottom wall.

2. The basketball of claim 1, wherein the channel depth is about 3.5 mm.

3. The basketball of claim 1, wherein the ridge distance is about 11 mm.

4. The basketball of claim 1, wherein the bottom wall defines a bottom wall length, and wherein the bottom wall length is between about 2 mm and about 4 mm.

5. The basketball of claim 4, wherein each of the grooves defines an outer wall distance, and wherein the outer wall distance is between about 13 mm and about 15 mm.

6. The basketball of claim 1, wherein the bottom wall, the first side wall, and the second side wall create a trapezoidal shape in the central channel.

7. The basketball of claim 1, wherein the basketball comprises a highly contrasted color scheme.

8. The basketball of claim 7, wherein the plurality of cover panels are black and the plurality of grooves are orange.

9. A basketball defining a center point, the basketball comprising:

a carcass including a bladder and a plurality of grooves, wherein the bladder comprises an outer surface;

a cover assembly including a plurality of cover panels that are spaced apart by the plurality of grooves; and each of the plurality of grooves comprising a bottom wall positioned between a first rib and a second rib, wherein the first rib includes a first side wall coupled with the bottom wall, a first ridge coupled with the first side wall, a first upper wall coupled with the first ridge, and a first outer wall coupled between the first upper wall and the outer surface of the bladder, and wherein the second rib includes a second side wall coupled with the bottom wall, a second ridge coupled with the second side wall, a second upper wall coupled with the second ridge, and a second outer wall coupled between the second upper wall and the outer surface of the bladder, wherein the basketball defines a first radius (R1) from the center point of the basketball to the outer surface of the bladder, a second radius (R2) from the center point of the basketball to the first or second ridge, and a third radius (R3) from the center point of the basketball to the bottom wall of the groove, wherein a difference between the first radius and the third radius (R1-R3) is bigger than a difference between the second radius and the first radius (R2-R1), wherein the first side wall of the first rib is angled outward from the bottom wall, the first upper wall is angled downward from the first ridge, and the first outer wall extends between the first upper wall and the outer surface of the bladder perpendicular to an entirety of the bottom wall, and wherein the second side wall of the second rib is angled outward from the bottom wall, the second upper wall is angled downward from the second ridge, and the second outer wall extends between the second upper wall and the outer surface of the bladder perpendicular to an entirety of the bottom wall.

10. The basketball of claim 9, wherein the first rib comprises the first ridge between the first side wall and the first upper wall, the second rib comprises the second ridge between the second side wall and the second upper wall, and the first ridge and the second ridge are parallel with the bottom wall.

11. The basketball of claim 9, wherein the first side wall and the second side wall each extend from the bottom wall at a side wall angle.

12. The basketball of claim 11, wherein the side wall angle is greater than 90°.

13. A basketball, comprising:

a carcass including a bladder and at least one groove;

a first cover panel and a second cover panel, wherein the at least one groove is positioned between the first cover panel and the second cover panel, and wherein each of the first cover panel and the second cover panel comprises a middle region and a peripheral region; and the at least one groove comprising a bottom wall positioned between a first rib and a second rib, wherein the at least one groove comprises a central channel disposed between the first rib, the second rib, and the bottom wall, wherein the first rib includes a first side wall coupled with the bottom wall, a first ridge coupled with the first side wall, a first upper wall coupled with the first ridge, and a first outer wall coupled between the first upper wall and the bladder, and wherein the second rib includes a second side wall coupled with the bottom wall, a second ridge coupled with the second side wall, a second upper wall coupled with the second ridge, and a second outer wall coupled between the second upper wall and the bladder, wherein the at least one groove comprises a first side channel between the first outer wall of the first rib and an outer surface of the first cover panel, wherein the at least one groove comprises a second side channel between the second outer wall of the second rib and an outer surface of the second cover panel, wherein the bottom wall is substantially flat, wherein an angle between the bottom wall and the first side wall is greater than 100 degrees, and wherein an angle between the first upper wall and a plane extending through the first ridge is less than 80 degrees.

14. The basketball of claim 13, wherein a thickness of the first cover panel and the second cover panel tapers within the peripheral regions.

15. The basketball of claim 13, wherein the at least one groove is positioned between peripheral edges of the first cover panel and the second cover panel.

16. The basketball of claim 13, wherein the first upper wall and the second upper wall abut the peripheral edges of the first cover panel and the second cover panel, respectively.

17. The basketball of claim 9, wherein the third radius is smaller than the first radius and the second radius.

18. The basketball of claim 9, wherein the bottom wall is perpendicular to an axis extending through the center point of the basketball.

19. The basketball of claim 9, wherein an angle formed between the first upper wall and a plane extending normal to R2 at a radially outwardmost point of the first upper wall is between about 1 and about 80 degrees.

20. The basketball of claim 1, wherein the first ridge and the second ridge are substantially parallel to the bottom wall.

* * * * *